US005720323A

United States Patent [19]

Tremer

[11] Patent Number: 5,720,323

[45] Date of Patent: Feb. 24, 1998

[54] METHOD AND APPARATUS FOR MECHANICALLY PRODUCING A WOVEN FABRIC ENDLESS SEAM

[76] Inventor: Siegmund Tremer, Tulpenstrasse 6, 95496 Glashuetten, Germany

[21] Appl. No.: 601,547

[22] Filed: Feb. 14, 1996

[30] Foreign Application Priority Data

Feb. 16, 1995 [DE] Germany ..... 195 05 280.3

[51] Int. Cl.[6] ..... D03D 3/04

[52] U.S. Cl. ..... 139/446; 28/141; 139/1 R; 139/383 AA

[58] Field of Search ..... 139/446, 1 R, 139/383 AA; 28/141

[56] References Cited

U.S. PATENT DOCUMENTS

| | | | |
|---|---|---|---|
| 3,238,594 | 3/1966 | Schuster | 139/383 AA |
| 3,955,603 | 5/1976 | Martelli | 139/446 |
| 4,410,015 | 10/1983 | Koller et al. | 139/383 AA |
| 5,027,483 | 7/1991 | Anderson | 139/383 AA |
| 5,123,455 | 6/1992 | Maina | 139/452 |
| 5,390,708 | 2/1995 | Kuster et al. | 139/383 AA |

FOREIGN PATENT DOCUMENTS

| | | |
|---|---|---|
| 0440595 | 8/1991 | European Pat. Off. . |
| 0610881 | 8/1994 | European Pat. Off. . |
| 3025909 | 2/1982 | Germany . |
| 8400782 | 3/1984 | Germany . |
| 3446941 | 7/1986 | Germany . |
| 3823715 | 1/1990 | Germany . |
| 4215971 | 12/1993 | Germany . |

*Primary Examiner*—Andy Falik
*Attorney, Agent, or Firm*—Laubscher & Laubscher

[57] ABSTRACT

A method for mechanically producing a seam half or a seam for making a length of woven fabric endless is characterized by the length of woven fabric being formed of warp threads extending longitudinally to the direction of the length of woven fabric as well as of weft threads extending transversely to the direction, wherein the warp threads are released from the woven material in an end portion or in both end portions of the length of woven fabric and woven as auxiliary weft threads into auxiliary warp threads in accordance with a weaving order predetermined for producing the seam half or the seam. In the end portion or in one of the two end portions, a group of weft threads, which borders on the non-opened length of woven fabric in the direction of the length of woven fabric and which has been exposed by releasing the warp thread ends from the woven material, is used as auxiliary warp threads.

26 Claims, 26 Drawing Sheets

METHOD AND APPARATUS FOR MECHANICALLY PRODUCING A WOVEN FABRIC ENDLESS SEAM

FIELD OF THE INVENTION

The present invention relates to a method for mechanically producing a seam half or a seam for making a length of woven fabric endless, said length of woven fabric being formed of warp threads extending longitudinally to the direction of said length of woven fabric as well as of weft threads extending transversely to said direction, wherein the warp threads are released from the woven material in an end portion or in both end portions of the length of woven fabric and the warp thread ends are deposited such that they are woven into auxiliary warp threads as auxiliary weft threads in accordance with a weaving pattern predetermined for producing said seam half or said seam.

The present invention additionally refers to an apparatus for mechanically producing a seam half, comprising a shedding mechanism used for forming a weaving shed by means of auxiliary warp threads, warp thread ends which have been removed from the woven material by weaving out in an end portion of the length of woven fabric being woven into said auxiliary warp threads as auxiliary weft threads, and a weaving-in means for weaving auxiliary weft threads which have been released from the woven material into the auxiliary warp threads in a weaving-in area of the weaving shed in accordance with a weaving order predetermined for producing the seam half, and it also refers to an apparatus for mechanically producing a seam, comprising a shedding mechanism used for forming a weaving shed by means of auxiliary warp threads, warp thread ends which have been removed from the woven material by weaving out in both end portions of the length of woven fabric being woven into said auxiliary warp threads as auxiliary weft threads, and two weaving-in means for weaving auxiliary weft threads which have been released from the woven material into the auxiliary warp threads in a weaving-in area of the weaving shed in accordance with a weaving order predetermined for producing the seam.

Lengths of woven fabric of the type mentioned hereinbefore especially include dehydration or drying screens used in paper industry.

BRIEF DESCRIPTION OF THE PRIOR ART

A Method and apparatuses of this type are known from DE-A-38 23 715. Said DE-A-38 23 715 discloses in particular that the warp thread ends are held in a so-called magazining bunch. Such a magazining bunch includes weft threads for holding the warp thread ends so that, when a shed is formed with these weft threads, the warp thread ends are released individually for weaving in in the seam area according to the position of the shed. Furthermore, the warp thread ends are woven into a number of prepared auxiliary warp threads for forming the seam. The step of providing the magazining bunches as well as the step of preparing the auxiliary warp threads are, however, rather time-consuming.

DE-A-42 15 971 discloses a method as well as an apparatus for carrying out said method in the case of which no magazining bunch is used. In this method, the warp thread ends of the end portions of a length of woven fabric are exposed by removing the weft threads. These warp thread ends are raised above the plane of the woven fabric and held in line by a part of the base fabric which, when seen in the direction of the seam, remained in front of the seam. In addition, an auxiliary shed is formed by means of the weft threads of said base fabric so as to separate from said base fabric the warp thread end which is the front warp thread end when seen in the direction of weaving. Also this method comprises the step of weaving the warp thread ends into auxiliary warp threads which have already been prepared. Although time can be saved by means of this method in comparison with the method making use of a magazining bunch, the steps of preparing the ends of the length of woven fabric and the auxiliary warp threads are still time-consuming.

SUMMARY OF THE INVENTION

Hence, it is the object of the present invention to improve the method as well as the apparatuses of the type mentioned at the beginning.

In accordance with the present invention, this object is achieved by the feature that, in the end portion or in one of the two end portions, a group of weft threads, which borders on the non-opened length of woven fabric in the direction of the length of woven fabric and which has been exposed by releasing the warp thread ends from the woven material, is used as auxiliary warp threads.

In the case of the present invention, it is, consequently, no longer necessary to prepare the ends of the length of woven fabric and the auxiliary warp threads. The production time and the production cost for the production of a seam half or of a seam for making a length of woven fabric endless will thus be reduced as a whole.

In view of the fact that the auxiliary warp threads are obtained directly from the woven fabric, material can be saved as well. Also this will result in a reduction of costs in the production of an endless screen.

One embodiment of the method according to the present invention used for producing a helical seam half, said helical seam half being also referred to as a seam which is open on one side thereof, is characterized by the features that, starting from a first side of the length of woven fabric or from an area in the vicinity of the first side, the ends of a predetermined number of warp threads, which follow one after the other in the direction of the second side of the length of woven fabric, are successively released from the woven material and deposited as auxiliary weft threads, that, by means of the weft threads (auxiliary warp threads) exposed in the area in which the warp thread ends have been released from the woven material, a weaving shed is formed, which has a weaving-in area and a weaving-out area in its open condition, said weaving-in area facing the first side of the length of woven fabric and said weaving-out area facing the second side of said length of woven fabric, and the auxiliary warp threads which are located adjacent the non-opened woven material in the direction of the length of woven fabric defining a first auxiliary warp thread group, whereas the more remote auxiliary warp threads define a second auxiliary warp thread group, that, in the weaving-in area, the respective first deposited auxiliary weft thread is woven in according to the predetermined weaving order in such a way that a wire helix provided between said first and second auxiliary warp thread groups is connected to the length of woven fabric by weaving in all auxiliary weft threads, that, in the weaving-out area, the respective subsequent warp thread end which still forms part of the woven material of the length of woven fabric is removed by weaving out and deposited as auxiliary weft thread, and that each weaving-in operation of the respective first auxiliary weft thread deposited has associated therewith a weaving-out operation of the respective subsequent warp thread end which still forms part of the woven material, whereby the weaving shed migrates from the first to the second side of the length of woven fabric.

The screens which have been made endless by a helical seam offer the advantage that they may be made endless in the suction extractor or in the dryer section of the paper-making machine itself by joining the two prepared helical seam halves.

An additional embodiment of the method according to the present invention is used for producing a pin seam, which is also referred to as endless open seam, for making the length of woven fabric endless. This embodiment is characterized by the features that, starting from a first one of the two ends and from a first side of the length of woven fabric or from a first one of the two ends and from an area in the vicinity of the first side, the ends of a predetermined number of warp threads, which follow one after the other in the direction of the second side of the length of woven fabric, are successively released from the woven material and deposited as auxiliary weft threads in a first group of auxiliary weft threads, that, by means of the weft threads (auxiliary warp threads) exposed in the area in which the warp thread ends of the first end of the length of woven fabric have been released from the woven material, a weaving shed is formed, which has a weaving-in area and a weaving-out area in its open condition, said weaving-in area facing the first side of the length of woven fabric and said weaving-out area facing the second side of said length of woven fabric, and the auxiliary warp threads which are located adjacent the non-opened woven material in the direction of the length of woven fabric defining a first auxiliary warp thread group, whereas the more remote auxiliary warp threads define a second auxiliary warp thread group, that, starting from the second end and the first side of the length of woven fabric or from the second end and an area in the vicinity of the first side, the ends of a predetermined number of warp threads, which follow one after the other in the direction of the second side of the length of woven fabric, are successively released from the woven material and deposited as auxiliary weft threads of a second auxiliary weft thread group, that, by means of the weft threads (auxiliary warp threads) exposed in the area in which the warp thread ends of the second end of the length of woven fabric have been released from the woven material, an auxiliary weaving shed is formed, which has a weaving-out area in its open condition, said weaving-out area being located in the vicinity of the weaving-out area of the weaving shed, that, in the weaving-in area of the weaving shed, the respective first deposited auxiliary weft thread of the first auxiliary weft thread group is woven in according to the predetermined weaving order in such a way that a central wire provided between said first and second auxiliary warp thread groups is releasably connected to the length of woven fabric of the first end by weaving in all auxiliary weft threads of said first auxiliary weft thread group, and that, subsequently, the respective first deposited auxiliary weft thread of the second auxiliary weft thread group is woven in according to the predetermined weaving order in such a way that the central wire is releasably connected to the length of woven fabric of the second end by weaving in all auxiliary weft threads of the second group of auxiliary weft threads, whereby the first end of the length of woven fabric is releasably connected to the second end thereof, that, in the weaving-out area of the weaving shed, the respective subsequent warp thread end which still forms part of the woven material of the first end of the length of woven fabric is removed by weaving out and deposited as auxiliary weft thread in the first auxiliary weft thread group, and that, in the weaving-out area of the auxiliary weaving shed, the respective subsequent warp thread end which still forms part of the woven material of the second end of the length of woven fabric is removed by weaving out and deposited as auxiliary weft thread in the second auxiliary weft thread group, and that each weaving-in operation of the respective first deposited auxiliary weft threads of the first and second auxiliary weft thread groups has associated therewith a weaving-out operation of the respective subsequent warp thread ends which still form part of the woven material of the first and second ends, whereby the weaving shed and the auxiliary weaving shed migrate from the first to the second side of the length of woven fabric.

Also a woven fabric provided with a pin seam can be made endless in the suction extractor or in the dryer section of a paper-making machine. Due to the use of a central wire, the pin seam is, moreover, more similar to the structure of the woven fabric than a helical seam. It follows that the quality of the paper dehydrated or dried in the area of the seam can be increased.

Both embodiments can be further developed in an advantageous manner by the features that at least some of the auxiliary weft threads which have already been woven in up to the wire helix or up to the central wire are temporarily deposited prior to being woven back and that the the weaving-in operation for these threads is not finished until the weaving-in operation for one or more additional auxiliary weft threads has been started or finished.

Furthermore, when the temporarily deposited threads are picked up for finishing the weaving operation concerning the respective thread, said threads can be turned about their longitudinal axis. The additional twisting of the threads by 180°, which is inherent in the methods according to the prior art, can selectively be compensated for in this way.

The above-mentioned further developments can both be used for mechanically producing any kind of complicated seams, which could only be woven by hand up to now. In this way, it is possible to adapt the strength of the seam to the respective requirements which have to be fulfilled by said seam.

A further embodiment of the method for producing an endless seam according to the present invention is characterized by the features that, starting from a first one of the two ends and from a first side of the length of woven fabric or from a first one of the two ends and from an area in the vicinity of the first side, the ends of a predetermined number of warp threads, which follow one after the other in the direction of the second side of the length of woven fabric, are successively released from the woven material and deposited as auxiliary weft threads in a first group of auxiliary weft threads, that by means of the weft threads (auxiliary warp threads) exposed in the area in which the warp thread ends of the first end of the length of woven fabric have been released from the woven material a weaving shed is formed, which has a weaving-in area and a weaving-out area in its open condition, said weaving- in area facing the first side of the length of woven fabric and said weaving-out area facing the second side of said length of woven fabric, that, starting from the second end and the first side of the length of woven fabric or from the second end and an area in the vicinity of the first side, the ends of a predetermined number of warp threads which follow one after the other in the direction of the second side of the length of woven fabric, are successively released from the woven material and deposited as auxiliary weft threads of a second auxiliary weft thread group, that, by means of the weft threads (auxiliary warp threads) exposed in the area in which the warp thread ends of the second end of the length of woven fabric have been released from the woven material, an auxiliary weaving shed is formed, which has a weaving-out area in its open condition, said weaving-out area being located in the vicinity of the weaving-out area of the weaving shed, that, in the weaving-in area of the weaving shed, the respective first deposited auxiliary weft thread of the first auxiliary weft thread group is woven into the auxiliary warp threads according to the predetermined weaving order up to a respective predetermined auxiliary warp thread where it is guided out of the weaving plane and that, subsequently, the respective first deposited auxiliary weft thread of the second auxiliary weft thread group is woven into the auxiliary warp threads according to the predetermined weaving order up to said predetermined auxiliary warp thread where it is guided out of the weaving plane so that the first end of the length of woven fabric is connected to the second end thereof by weaving in all auxiliary weft threads of said first and second auxiliary weft thread groups, that, in the weaving-out area of the weaving shed, the respective subsequent warp thread end which still forms part of the woven material of the first end of the length of woven fabric is removed by weaving out and deposited as auxiliary weft thread in the first auxiliary weft thread group, and that, in the weaving-out area of the auxiliary weaving shed, the respective subsequent warp thread end which still forms part of the woven material of the second end of the length of woven fabric is removed by weaving out and deposited as auxiliary weft thread in the second auxiliary weft thread group, and that each weaving-in operation of the respective first deposited auxiliary weft threads of the first and second auxiliary weft thread groups has associated therewith a weaving-out operation of the respective subsequent warp thread ends which still form part of the woven material of the first and second ends, whereby the weaving shed and the auxiliary weaving shed migrate from the first to the second side of the length of woven fabric.

In comparison with the types of seams described hereinbefore, an endless seem has the advantage that it is most similar to the structure of the woven fabric and that, consequently, the paper formed in this area will have the highest quality.

The embodiments provided with a weaving shed as well as with an auxiliary weaving shed can be further developed in an advantageous manner insofar as the weaving shed and the auxiliary weaving shed are coupled such that the weaving-out operations in the area of both ends of the length of woven fabric are carried out simultaneously. This further development will reduce the production time.

In addition, all three embodiments show the feature that the auxiliary weft threads are removed from the woven material by weaving out, i.e. they are exposed by a shed position in accordance with the weaving order and then they are guided out of the weaving shed. This offers the advantage that no preliminary damage will be caused to the bent or cranked shape of the threads, and this will have the effect that a screen produced by means of the method according to the present invention will have less defects, i.e. a higher quality, than a screen produced with the aid of a conventional method.

For carrying out the method according to the present invention which serves to mechanically produce a seam half, an apparatus of the type mentioned at the beginning is used, which is characterized by a means for weaving out warp thread ends which are to be released from the woven material in a weaving-out area located opposite the weaving-in area of the shed, in such a way that a group of weft threads of the end portion of the length of woven fabric is partially exposed and that these weft threads in the exposed area are used as auxiliary warp threads for forming the weaving shed, and a magazining device for defined deposition of the warp thread ends, which have been removed from the woven material with the aid of the weaving-out means, as auxiliary weft threads and for transferring to the weaving-in means the respective first auxiliary weft thread deposited.

This apparatus can be further developed in an advantageous manner by the features that a control unit is provided, which temporally controls the weaving-in means, the weaving-out means and the magazining device as well as the shedding mechanism for producing a helical seam, said control unit being of such a nature that each weaving-in operation of the respective first auxiliary weft thread deposited in said magazining device has associated therewith a weaving-out operation of the respective subsequent warp thread end forming still part of the woven material.

According to the present invention, a seam can be produced mechanically by an apparatus of the type mentioned at the beginning, said apparatus being characterized by a first means for weaving out warp thread ends, which are to be released from the woven material and which are taken from one of the end portions of the length of woven fabric, in a weaving-out area located opposite the weaving-in area of the shed, in such a way that a group of weft threads in this end portion is partially exposed and that these weft threads in the exposed area are used as auxiliary warp threads for forming the weaving shed, a first magazining device for defined deposition of the warp thread ends, which have been removed from the woven material with the aid of the first weaving-out means, as auxiliary weft threads and for transferring to the first weaving-in means the respective first auxiliary weft thread deposited, an auxiliary shedding mechanism for forming an auxiliary weaving shed with a weaving-out area, a second means for weaving out warp thread ends, which are to be released from the woven material and which are taken from the other end portion of the length of woven fabric, in the weaving-out area of the auxiliary weaving shed, in such a way that a group of weft threads in this end portion of the length of woven fabric is partially exposed and that these weft threads in the exposed area are used as auxiliary warp threads for forming the auxiliary weaving shed, and a second magazining device for defined deposition of the warp thread ends, which have been removed from the woven material with the aid of the second weaving-out means, as auxiliary weft threads, and for transferring to the second weaving-in means the respective first auxiliary weft thread deposited.

For producing a pin seam, this apparatus can be provided with a control unit for temporally controlling both weaving-in means, both weaving-out means and both magazining devices as well as the shedding mechanism and the auxiliary shedding mechanism for producing a pin seam, said control unit being of such a nature that an auxiliary weft thread from the first magazining device and an auxiliary weft thread from the second magazining device are used alternately for the weaving-in operation and that each weaving-in operation carried out by said first and second weaving-in means, respectively, has associated therewith a weaving-out operation carried out by said first and second weaving-out means, respectively.

In addition, the weaving-in means can be further developed in an advantageous manner by the features that each weaving-in means comprises a weaving-in gripper which is adapted to be pivoted into the weaving-in area of the weaving shed, and a deposition device for temporarily receiving therein one or a plurality of auxiliary weft threads woven in by the weaving-in gripper, said deposition device being provided in the area in which the end of the weaving-in gripper is located when it has been pivoted in.

On the one hand, this deposition device is adapted to be used for mechanically producing even complicated weaving patterns. On the other hand, the thread woven in can be turned about its longitudinal axis by means of such a deposition device prior to be woven back. The 180° twisting of the threads, which is inherent in conventional weaving-in means, can selectively be compensated for in this way.

For producing an endless seam, the apparatus can be provided with a control unit for temporally controlling both weaving-in means, both weaving-out means and both magazining devices as well as the shedding mechanism and the auxiliary shedding mechanism for producing an endless seam, said control unit being of such a nature that an auxiliary weft thread from the first magazining device and an auxiliary weft thread from the second magazining device are used alternately for the weaving-in operation and that the respective weaving-in and weaving-out operations performed by said first weaving-in and weaving-out means as well as the respective weaving-in and weaving-out operations performed by said second weaving-in and weaving-out means are carried out alternately.

For producing an endless seam, the apparatus can be provided with weaving-in means which are characterized in that each weaving-in means is provided with a weaving-in gripper which is adapted to be pivoted into the weaving-in area of the weaving shed.

In contrast to the production of a pin seam, the use of a deposition device is, consequently, not absolutely necessary in this case.

Furthermore, the shedding mechanism and the auxiliary shedding mechanism of the apparatus used for producing a seam can be coupled such that the weaving-out operations of the respective first warp thread ends forming still part of the woven material of the first and second end portions of the length of woven fabric take place simultaneously. Due to the fact that the warp thread ends are simultaneously removed by weaving out in both end portions of the length of woven fabric, the time required for producing a seam will be reduced, and this will permit a more efficient use of the apparatus.

The magazining devices of all the apparatuses according to the present invention can be characterized by the features that each magazining device comprises a transfer means providing the end of the respective warp thread, which has been removed by weaving out and made availabe by the respective weaving-out means, with a clip and transferring said clip to a rail onto which the clip can be threaded and along which said clip can slidably be moved, and a transfer means for transferring to the weaving-in means the respective first clip which has been deposited.

Alternatively to a clip, it is also possible to secure an auxiliary member having a suitable shape to the warp thread end, e.g. by means of welding, by means of an adhesive or by casting in the thread end.

By means of this arrangement, the warp thread ends which have been removed by weaving out can be deposited safely on one side of the rail and picked up on the other side of the rail as auxiliary weft threads, since, by threading one clip at a time on the rail, all clips (and the warp thread ends secured thereto) are displaced along the rail, and, consequently, one clip with an auxiliary weft thread will always be made available to the weaving-in means on the other side of the rail. It follows that the warp thread ends are guided automatically from the weaving-out area of the weaving shed (and of the auxiliary weaving shed, respectively) to the weaving-in area thereof.

In addition, by threading the warp thread ends on the rail, the warp threads provided for weaving in can be prevented from getting mixed up. An error source, which would result in a substantial deterioration of the quality of the seam produced, is eliminated in this way. Since it is, in addition, only necessary to thread the clips on the rail and to remove them from the rail, respectively, the control means for the transfer means and the transfer means can have a comparatively simple structural design.

The weaving-in gripper used in the weaving-in means can be characterized by an essentially straight gripper arm, and a first holding device on which the gripper is supported such that it is adapted to be rotated about a first axle and such that it is adapted to be pivoted about said first axle with the aid of a first drive means relative to said first holding device, said first holding device being adapted to be pivoted about a second axle with the aid of a second drive means relative to a second holding device, and said second axle including an angle with said first axle.

On the basis of this arrangement, the weaving-in gripper can be provided in the area between the auxiliary warp threads and the non-opened woven material on the side of the weaving plane located opposite the magazining device. In this way, it is, on the one hand, possible to prevent the gripper from being impeded by the deposited warp thread ends during a weaving-in operation and, on the other hand, the gripper can directly take over the warp thread end from the magazining device and guide said warp thread end through the weaving plane for the purpose of weaving in. Hence, it is not necessary to provide any additional means which takes over from the magazining device the auxiliary weft thread to be woven in and guides said auxiliary weft thread through the weaving plane where it could be taken over by a gripper. On the basis of this arrangement, the auxiliary weft thread taken over can, in addition, be woven into the woven material simply by pivoting in the gripper. In particular in connection with the auxiliary weft threads which need not be woven back, i.e. in the case of half of all the threads of a helical seam or of a pin seam as well as in the case of all the threads of an endless seam, time will be saved in this way, and this will, in turn, permit a more efficient use of the apparatus.

The weaving-in gripper can in an advantageous manner be characterized by the feature that the gripper arm comprises a plurality of lamellae which are arranged such that they are adapted to be displaced from a first position to a second position essentially at right angles to the axis of the gripper arm, a weft thread introduced in the weaving shed being beaten up at said second position, when the gripper is pivoted into the weaving-in area of a weaving shed.

Due to the fact that these lamellae are provided on the gripper arm, the weft thread introduced in the shed can be beaten up in the condition in which the gripper arm has been pivoted in. It follows that this gripper also fulfills the function of a reed, whereby the structural design of the weaving-in means as a whole is simplified.

Furthermore, the control of the lamellae can be constructed such that, starting from the side of the non-opened woven material, the individual lamellae successively beat up the thread. In this way, it can be guaranteed that the bent or cranked weft thread is woven into the correspondingly bent or cranked warp threads. Possible weaving faults, which may be caused due to the fact that the bends or cranks of the weft thread are not positioned in the corresponding bends or cranks of the warp thread before the thread is beaten up, can be avoided in this way.

Moreover, the gripper arm can be provided with a tape gripper in an advantageous manner. It is, consequently, not necessary to provide an additional gripper taking over the auxiliary weft thread to be woven in for a possible weaving back operation.

In the apparatuses mentioned hereinbefore, weaving-out means can be used in an advantageous manner, said weaving-out means being characterized by the feature that they have a weaving-out gripper which is adapted to be pivoted into the weaving-out area of the weaving shed and of the auxiliary weaving shed, respectively.

This weaving-out gripper can be further developed in an advantageous manner by an essentially straight gripper arm provided with one or a plurality of gripper means for picking up a thread to be removed from the woven material by weaving out, a first holding device on which the gripper is supported such that it is adapted to be rotated about a first axle and such that it is adapted to be pivoted about said first axle with the aid of a first drive means relative to said first holding device, said first holding device being adapted to be pivoted about a second axle with the aid of a second drive means relative to a second holding device, and said second axle including an angle with said first axle.

Similar to the weaving-in means, also this arrangement offers the possibility of providing the gripper arm in the area between the auxiliary warp threads and the non-opened woven material on the side of the weaving plane located opposite the magazining device. It follows that also in the case of the weaving-out gripper the warp thread end which has been removed by weaving out can be guided through the weaving plane directly into the area of the magazining device without any necessity of providing additional means for this purpose.

Each gripper means of this weaving-out gripper can comprise a clip and a control for opening and closing said clip so that, when said clip is open and when the shed is at a suitable position, the thread to be removed by weaving out can be seized and fixed by closing the clip.

Furthermore, said weaving-out gripper can be supported by auxiliary means, which are arranged in the area in which the thread to be removed by weaving out is located and which support the seizing of the thread. This auxiliary means can have the form of a brush, which brushes said thread into the open clip when the shed is at a suitable position.

Furthermore, the clip can have at the ends thereof electrical contacts which are insulated from each other and which will close a circuit, if the thread to be removed by weaving out should slip out of the clip. This offers the possibility of stopping the apparatus immediately and of eliminating this fault without any damage being caused in the seam.

The gripper means can be provided with a control comprising a conical control element engaging, transversely to the longitudinal axis of the clip, an opening provided in said clip so that the clip will be opened and closed, respectively, by displacing the control element transversely to the longitudinal axis of said clip.

On the basis of this simple control, it is possible to produce the individual gripper means in modular construction. It follows that, depending on the requirements to be fulfilled, an arbitrary number of these modules can be connected in series, and this guarantees that the threads to be removed by weaving out will reliably be seized.

BRIEF DESCRIPTION OF THE DRAWINGS

Additional advantages of the present invention will be evident from the exemplary description of preferred embodiments, which follows hereinbelow and in which reference is made to the drawings.

DETAILED DESCRIPTION

Figure 1:
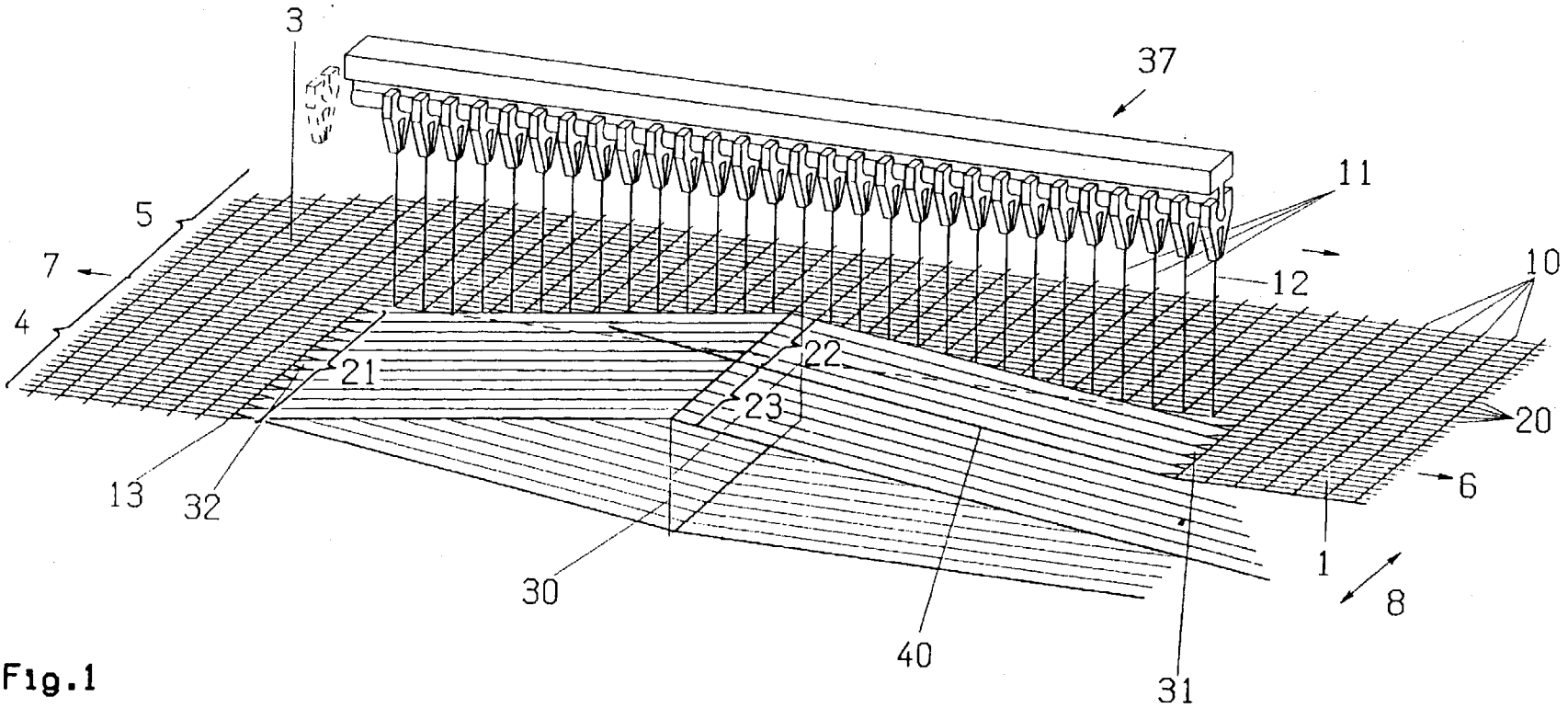
FIG. 1, 2 and 3 show schematic representations for explaining the method according to the present invention in accordance with a first embodiment.

FIG. 1 shows a schematic representation for explaining the method according to the present invention, which is used for mechanically producing a helical or spiral seam half 1 for making a length of woven fabric 3 endless. This length of woven fabric 3 is formed of warp threads 10 extending longitudinally to the direction 8 of said length of woven fabric as well as of weft threads 20 extending transversely to said direction. In an end portion 4 of said length of woven fabric 3, a predetermined number of warp thread ends 11 have already been removed from the woven material by weaving out, i.e. they have been exposed by a weaving-shed position and removed from said weaving shed and deposited in a deposition device 37, individually and in accordance with the weaving order, as auxiliary weft threads. According to FIG. 1, the deposition device 37 includes a rail on which elements (in FIG. 1 in the form of clips) are arranged in a row, said elements being releasably connected to the auxiliary weft threads. Means which are suitable for connecting the auxiliary weft threads to said elements and for fastening the elements to the rail will be described in detail in connection with FIG. 9. Also the weaving-out operation will be described more precisely hereinbelow. By removing the warp thread ends 11 from the woven material by weaving out, the weft threads 21 are partially exposed in the end portion 4. These partially exposed weft threads form a shed 30 having, in the open condition, a weaving-in area 3i and a weaving-out area 32. The weft threads 21 forming the weaving shed 30 are subdivided into a first auxiliary warp thread group 22 and into a second auxiliary warp thread group 23. The first auxiliary warp thread group 22 is located adjacent the non-opened woven material 5 and represents the auxiliary warp threads required for closing the woven material. Between the two auxiliary warp thread groups 22 and 23, a wire helix 40 is supplied in the weaving-in area of the shed. In response to a shed position given by the weaving order in the seam area—which weaving order will be described more precisely in connection with FIG. 4—the respective first auxiliary weft thread 12 deposited is now woven into the auxiliary warp thread group 22 in the weaving-in area 31 in such a way that a wire helix 40 supplied in the weaving-in area between the first auxiliary warp thread group 22 and the second auxiliary warp thread group 23 is connected to the length of woven fabric 3 by weaving in all auxiliary weft threads 11.

The element of the deposition device 37, which is now no longer occupied because the first auxiliary weft thread has been woven in, is removed, as indicated by an arrow. At the same time, an additional element (indicated by a broken line) is made available on the other side of the deposition device for the next warp thread end 13 which is to be released from the length of woven fabric. This warp thread end is removed from the woven material by weaving out, whereupon it is deposited in the element of the deposition device 37 which has just been made available. The weaving-in operation of the respective first auxiliary weft thread 12 deposited and the weaving-out operation of the respective subsequent warp thread end 13, which still forms part of the woven material, are carried out alternately. This has the effect that the weaving shed migrates from the first side 6 to the second side 7 of the length of woven fabric (the fact that neither of said sides can be seen in FIG. 1 is indicated by arrows adjacent the references numerals 6 and 7).

As indicated in FIG. 1, the alternate weaving-in and weaving-out has the effect that, on the one hand, the end portion 4 of said length of woven fabric 3 is opened on the left-hand side of the weaving shed. On the other hand, the wire helix 40 is woven into said opened part on the right-hand side of the weaving shed. The auxiliary warp threads 23 which are not required in the course of this process are discharged. Making reference to FIG. 2 and 3, it will be described hereinbelow how the weaving shed 30 is inserted in the end portion 4 of the length of woven fabric.

Figure 2:
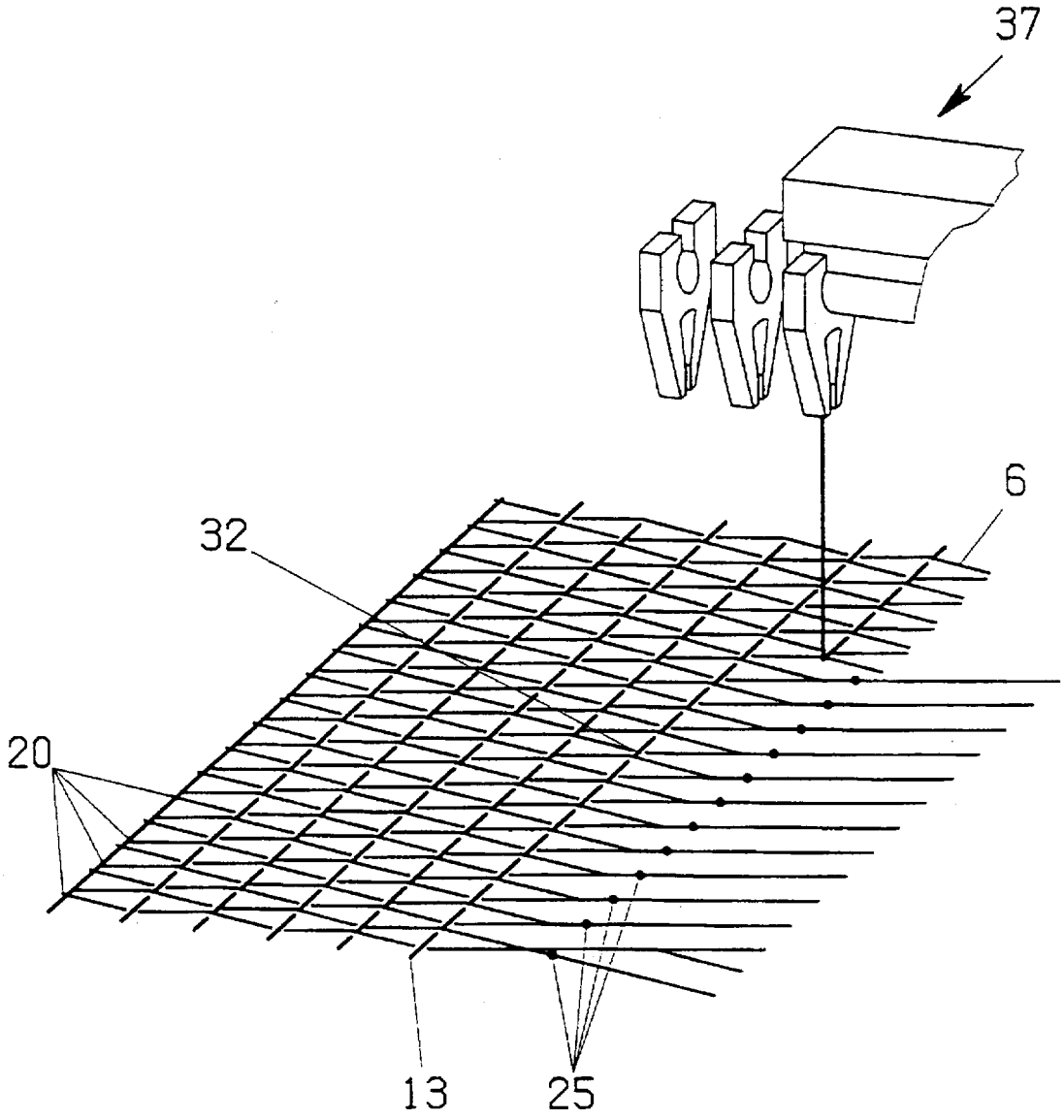

In FIG. 2, the first warp thread end 12 has already been released from the woven material on a first side 6 of the length of woven fabric and deposited in an element of the deposition device 37 as auxiliary weft thread. In order to permit shed formation by the weft threads 20, said weft threads are extended beyond the width of the length of woven fabric. For this purpose, holding means 25 are attached to the ends of the weft threads 20 according to FIG. 2. Alternatively, it would also be possible to use, upon weaving the length of woven fabric, in the end portions thereof weft threads which are longer than the width of said length of woven fabric and which, consequently, project beyond the width of said length of woven fabric.

At a shed position predetermined by the weaving order of the length of woven fabric, the next warp thread end 13 can now be removed from the woven material by weaving out, i.e. it can be exposed by an adequate position of the weaving shed and removed from the weaving-out area 32 and then deposited in the next element of the deposition device 37 as auxiliary weft thread. By changing the shed positions in an adequate manner, a predetermined number of warp thread ends 11 is now successively removed by weaving out, whereupon said warp thread ends 13 are successively deposited as auxiliary weft threads in the elements of the deposition device 37.

Figure 3:
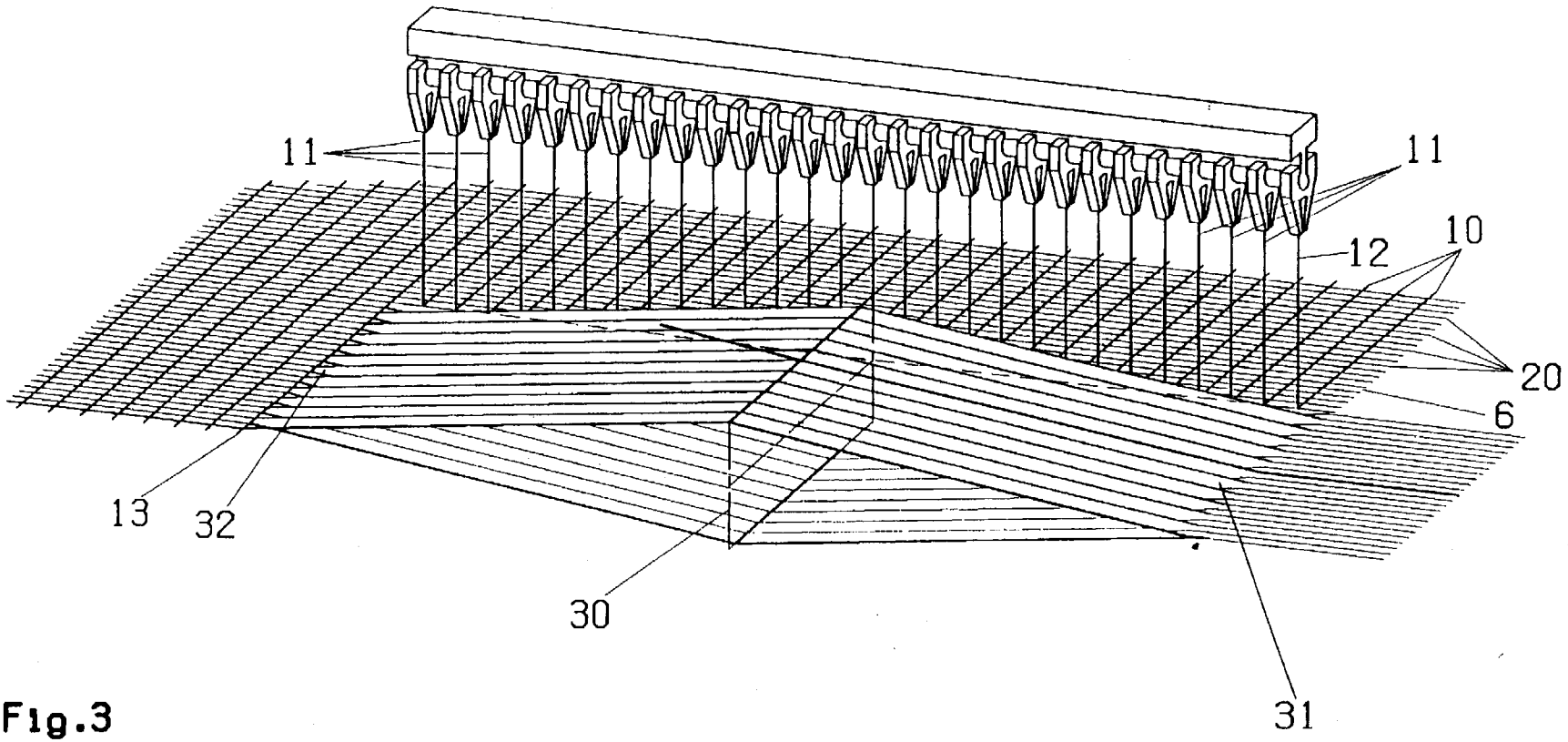

FIG. 3 shows the condition in which each element of the deposition device 37 has deposited therein one warp thread end 11 as auxiliary weft thread. The exposed parts of the weft threads 20 now form in the area in which the warp thread ends have been released from the woven material the weaving shed 30 comprising in its open condition the first weaving area 31 and the second weaving area 32.

In this condition, the next step is that the first auxiliary weft thread 12 deposited is woven in. Subsequently, the respective next warp thread end 13, which still forms part of the woven material, is removed by weaving out and the first weft thread 12 deposited is woven in, said operations bring carried out alternately as has already been explained in connection with FIG. 1.

This process is continued until the first warp thread end has been removed from the woven material by weaving out on the second side 7 of the length of woven fabric and deposited in the last element of the deposition device 37. The deposited auxiliary weft threads can then successively be woven into the weaving-in area 31 until the seam has been finished. In the course of this process, the weaving shed for these weaving-in operations is formed analogously to the weaving-out operation of the first warp thread ends (cf. FIG. 2) by weft threads extended beyond the width of the length of woven fabric. One possibility of achieving this is that weft threads which are longer than the width of the length of woven fabric are already used upon weaving the length of woven fabric, and another possibility is that the weft threads are extended by holding means corresponding to the means 25 in FIG. 2.

Alternatively to the method of inserting the weaving shed 30 into the end portion 4 of the length of woven fabric 3, which is described in FIG. 2 and FIG. 3, it is also possible to remove with the aid of a hook a first warp thread end 12 from the woven material in the vicinity of the first side 6 of the length of woven fabric and to deposit said first warp thread end as auxiliary weft thread in the first element of the deposition device 37. Taking this warp thread end as a basis, additional warp thread ends can now be released from the woven material in the direction of the second side 7 of the length of woven fabric and deposited one after the other in suitable elements of the deposition device 37. Due to this lateral strip, the weft threads 20 used for shed formation remain fixed so that the holding means 25 shown in FIG. 2 can be dispensed with.

Figure 4:
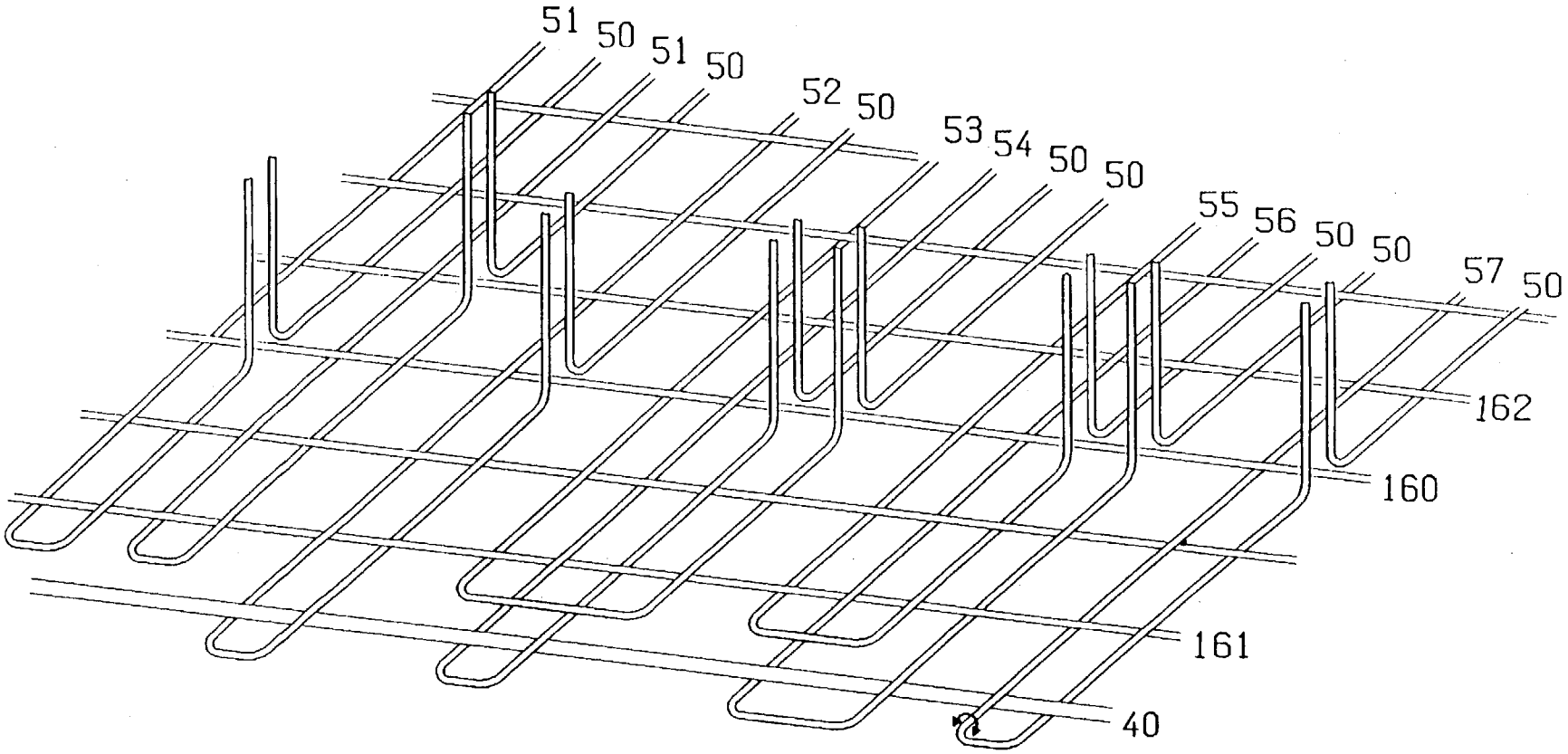
FIG. 4 shows various modes of guiding auxiliary weft threads round a wire helix or a central wire.

In FIG. 4 various weaving-in operations for connecting the wire helix 40 to the length of woven fabric 3 are shown. In the following, it is, however, only the way in which the auxiliary weft threads are guided round the wire helix which will be discussed in detail, since the shed control providing said guidance as well as the various weaving patterns for the strips of woven fabric are sufficiently known to the person skilled in the art.

During a first weaving-in operation, an auxiliary weft thread 51 is woven into a auxiliary warp thread group up to a last auxiliary warp thread 161 in accordance with a weaving order predetermined by the length of woven fabric, the auxiliary weft thread 51 being then guided round the last auxiliary warp thread 161 and woven back to a predetermined auxiliary warp thread 160 and there it is guided out of the weaving plane.

In a further weaving-in operation, an auxiliary weft thread 52 is woven into the auxiliary warp thread group up to the last auxiliary warp thread 161, whereupon it is guided round the wire helix 40 and woven back to a predetermined auxiliary warp thread 160 and there it is guided out of the weaving plane.

In order to prevent the thickness of the length of woven fabric from changing in the seam area due to the weaving back of the auxiliary weft threads 51 and 52, each of the two weaving-in operations must be supplemented by a complementary weaving-in operation. For this purpose, an auxiliary weft thread 50 is woven into the auxiliary warp thread group only up to the predetermined auxiliary warp thread 160 at which the auxiliary weft threads 51 and 52 have been guided out of the weaving plane, and there it is guided out of the weaving plane.

For increasing the stability of the seam area, it is possible to choose various auxiliary warp threads 160, 162 etc. at which the woven-in auxiliary weft threads 50 and 51 or 50 and 52 are to be guided away.

Figure 5:
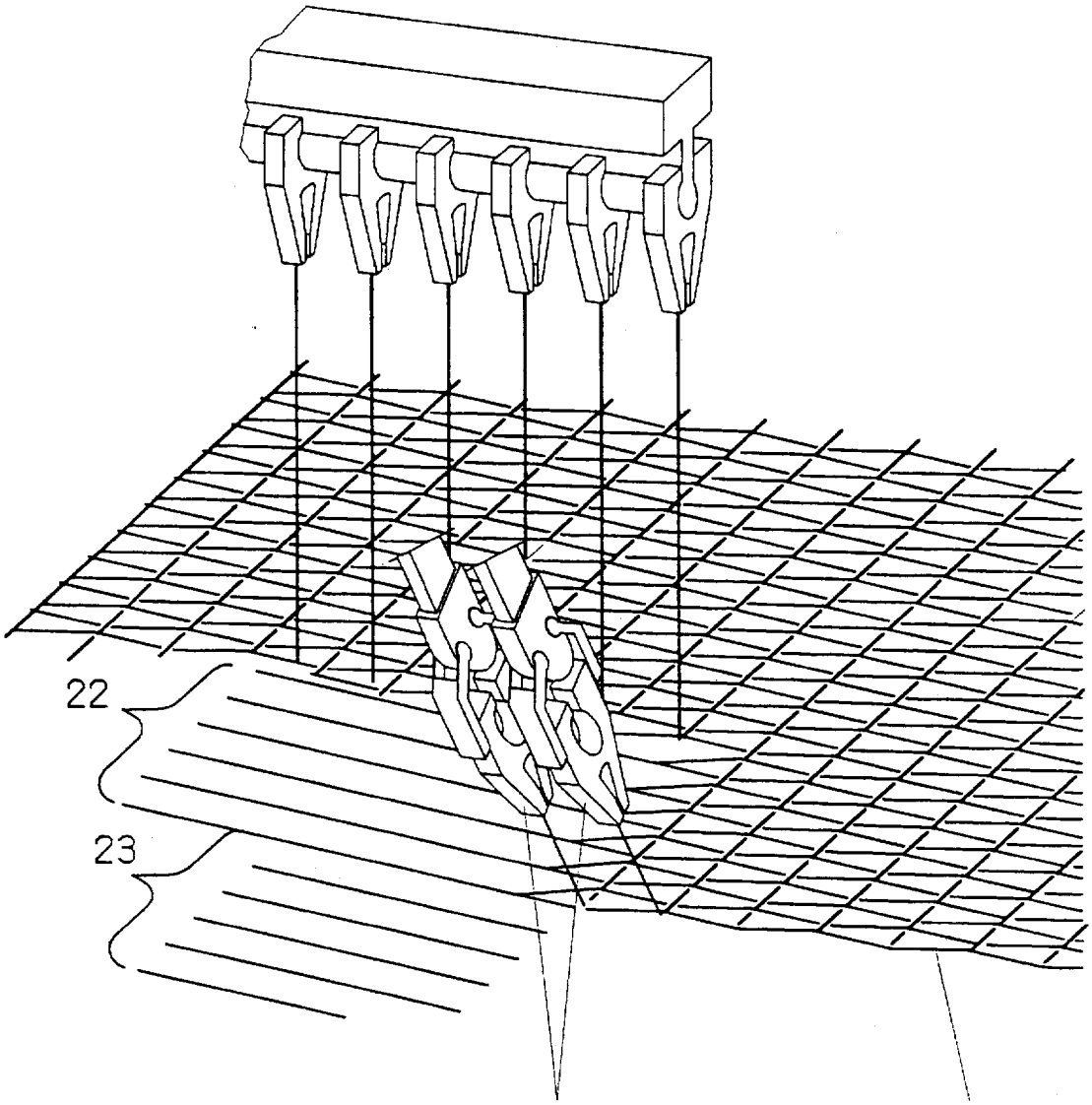
FIG. 5 shows a schematic representation for explaining the method according to the present invention in accordance with a second embodiment.

FIG. 5 shows a schematic representation for explaining an additional embodiment of the method according to the present invention. Said figure especially shows an intermediate deposition device 38 in which an auxiliary weft thread can first be deposited temporarily, this being an alternative to the immediate weaving back described hereinbefore. The weaving in of this auxiliary weft thread will not be finished until a weaving-in operation for one or more auxiliary weft threads has been started or finished.

With the aid of this means, also more complicated types of seams, which are shown in FIG. 4 by way of example, can be realized. An auxiliary weft thread 53 can, for example, be woven into the auxiliary warp thread group up to the last auxiliary warp thread 161 and there it can be deposited in the intermediate deposition device 38. Subsequently, an additional auxiliary weft thread 54 is woven into the auxiliary warp thread group up to the last auxiliary warp thread 161, whereupon it is passed round the wire helix 40, woven back up to a predetermined auxiliary warp thread 160, and there it is guided out of the weaving plane. This weaving operation is supplemented by a complementary weaving-in operation of a auxiliary weft thread 50 up to said predetermined auxiliary warp thread 160. Subsequently, the temporarily deposited thread 53 is guided round the last auxiliary warp thread 161 and woven back from said auxiliary warp thread 161 to said predetermined auxiliary warp thread 160 where it is then guided out of the weaving plane. It goes without saying that the complementary weaving-in operation also has to be carried out after this weaving operation.

In an additional example of a weaving operation, an auxiliary weft thread 55 is woven into the auxiliary warp threads up to the last auxiliary warp thread 161, and there it is deposited in a first element of the intermediate deposition device 38. Subsequently, an auxiliary weft thread 56 is woven in up to the last auxiliary warp thread 161, where it is deposited in a further element of the intermediate deposition device 38. Following this, the auxiliary weft thread 55 is guided round the last auxiliary warp thread 161 and woven back up to a predetermined auxiliary warp thread 160. This operation is again followed by the weaving-in operation of an auxiliary weft thread 50 up to the predetermined auxiliary warp thread 160. Subsequently, the auxiliary weft thread 56 is passed round the wire helix and woven back up to the predetermined auxiliary warp thread 160. Following this, the complementary weaving-in operation is again carried out.

By means of these different types of seams, which can only be carried out by hand in accordance with the prior art, the stability in the seam area of the length of woven fabric can be increased.

FIG. 4 shows that, in accordance with an additional embodiment of the weaving operation, an auxiliary weft thread 57 can be turned about its longitudinal axis prior to be woven back. The additional twisting of the threads by 180°, which is inherent in the method according to the prior art, can selectively be compensated for in this way.

It goes without saying that the types of seams described hereinbefore should only be considered as an enumeration of examples. In addition to these seams, numerous other types of seams, which are known to the person skilled in the art and which, up to now, could only be carried out by hand, can be realized with the aid of the method described hereinbefore.

Figure 6:
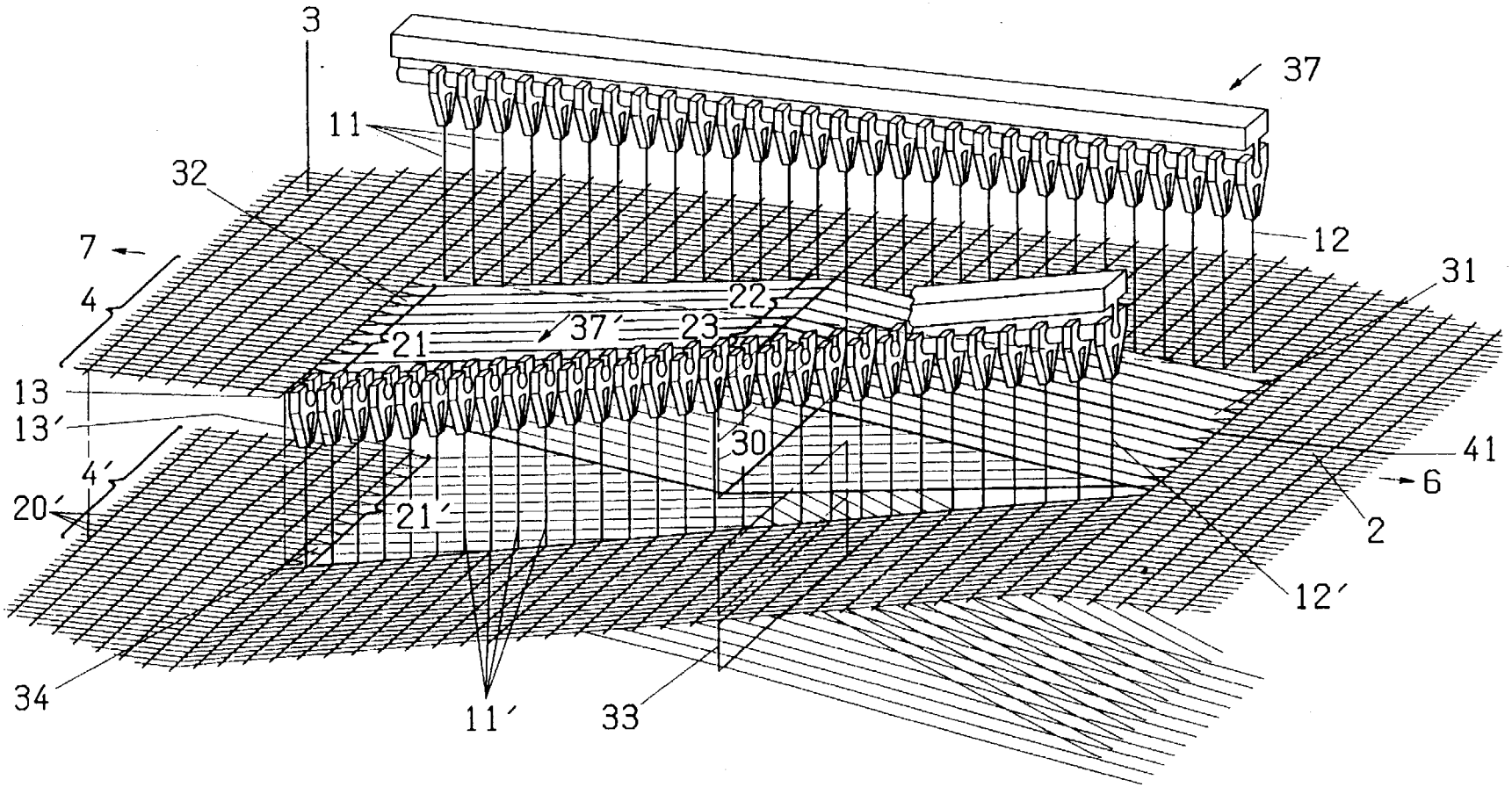
FIG. 6 shows a schematic representation for explaining the method according to the present invention in accordance with a third embodiment.

FIG. 6 shows a schematic representation for explaining the production of a pin seam for making a length of woven fabric 3 endless. In this embodiment, the two ends 4 and 4' of a length of woven fabric 3 are releasably interconnected by weaving threads round a central wire 41 alternately from the two ends of the length of woven fabric. Analogously to the methods described in FIG. 1 to 3, a shed 30 is here inserted into one end portion 4 of the length of woven fabric 3. In so doing, it is, consequently, possible to completely unweave one side 6 of the length of woven fabric and to provide holding means 25 on the weft threads 20 for forming a shed, or the weft threads 20 can be held by a lateral strip in which the woven material is not opened.

Furthermore, in contrast to the method described in FIG. 1, an auxiliary shed 33 with a weaving-out area 34 is provided. In this weaving-out area, the warp thread ends 11' are removed from the second end portion 4' of the length of woven fabric 3 by weaving out, and then they are deposited in a deposition device 37'. According to FIG. 6, the number of elements of the deposition device 37' corresponds to the number of elements of the deposition device 37; this is, however, not absolutely necessary.

The parts 21' of the weft threads 20' exposed by the removal of the warp thread ends 11' are only used for forming the auxiliary shed 33 and, subsequently, they are discharged. In contrast to the method according to FIG. 1, all auxiliary warp threads 21 of one end portion 4 of the length of woven fabric are used for forming the seam in the present case. The auxiliary warp threads 21 are subdivided into a first auxiliary warp thread group 22 and a second auxiliary warp thread group 23. Between these two groups of auxiliary warp threads, a central wire 41 is inserted in the area of the weaving-in shed 31 for releasably connecting the two ends 4 and 4' of the length of woven fabric.

In order to provide auxiliary weft threads 11 and 11' having approximately the same length and in order to avoid unnecessary difficulties in the control of the auxiliary shed 33, end portions 4 and 4' having approximately identical widths can be used. It is, however, only necessary to guarantee that the auxiliary weft threads 11 or 11' will not become too short for the weaving-in operation due to an uneven number of weft threads in the end portions 4 and 4'.

In the weaving-in area 31 of the shed 30, the first deposited auxiliary weft thread 12 from the first end portion 4 of the length of woven fabric and the first deposited auxiliary weft thread 12' from the second end portion 4' of the length of woven fabric are now woven into the first group of auxiliary warp threads 22 and the second group of auxiliary warp threads 23, respectivey, in accordance with a predetermined weaving order in such a way that, by weaving in all auxiliary weft threads 11 and 11', the first end as well as the second end of the length of woven fabric are releasably connected to the central wire 41, whereby a releasable connection of the two ends of the length of woven fabric is obtained.

Analogously to FIG. 1, also this embodiment includes the steps of removing the first elements of the deposition device 37 and 37' after the weaving-in operation and providing on the other side new elements for depositing therein the warp thread ends to be removed by weaving out.

In view of the fact that, in the case of this method, threads are to be woven round a central wire 41 whereby said central wire is to be connected to the ends of the length of woven fabric, the weaving-in operations explained in FIG. 4 for weaving threads round a wire helix can be used analogously. It follows that the advantages of an intermediate deposition device 38 and 38', which have been explained in connection with FIG. 4, can also be utilized in the present embodiment in an advantageous manner. In this way, it will especially be possible to mechanically produce seams which will provide an increased stability of the seam area as well as to selectively compensate the twisting of a thread along its longitudinal axis, which has already been mentioned hereinbefore.

In the weaving-out area 32 of the weaving shed 30 as well as in the weaving-out area 34 of the auxiliary weaving shed 33, the respective warp thread ends 13 and 13' following in the first and second end portions 4 and 4' and constituting still part of the woven material are removed by weaving out and deposited in the deposition devices 37 and 37', respectively.

Analogously to the method according to FIG. 1, the weaving-in and weaving-out operations in the weaving-in area 31 and the weaving-out areas 32 and 34 are again carried out alternately so that the weaving shed 30 as well as the auxiliary weaving shed 33 migrate from the first side 6 of the length of woven fabric to the second side 7.

The sequence of the individual weaving operations, i.e. the weaving in of the first auxiliary weft thread 12, the weaving in of the first auxiliary weft thread 12', the removal of the warp thread end 13 by weaving out and the removal of the warp thread end 13' by weaving out can be exchanged at will. It must only be guaranteed that, when the weaving-in operations have been finished, a warp thread end 13 and 13', respectively, is removed from the woven material by weaving out and transferred to the deposition device 37 and 37', respectively, for each auxiliary weft thread 12 and 12' which has been woven in.

For reducing the production time, the weaving shed 30 and the auxiliary weaving shed 33 can be coupled such that the respective warp thread ends 13 and 13' to be removed by weaving out can be removed simultaneously.

Figure 7:
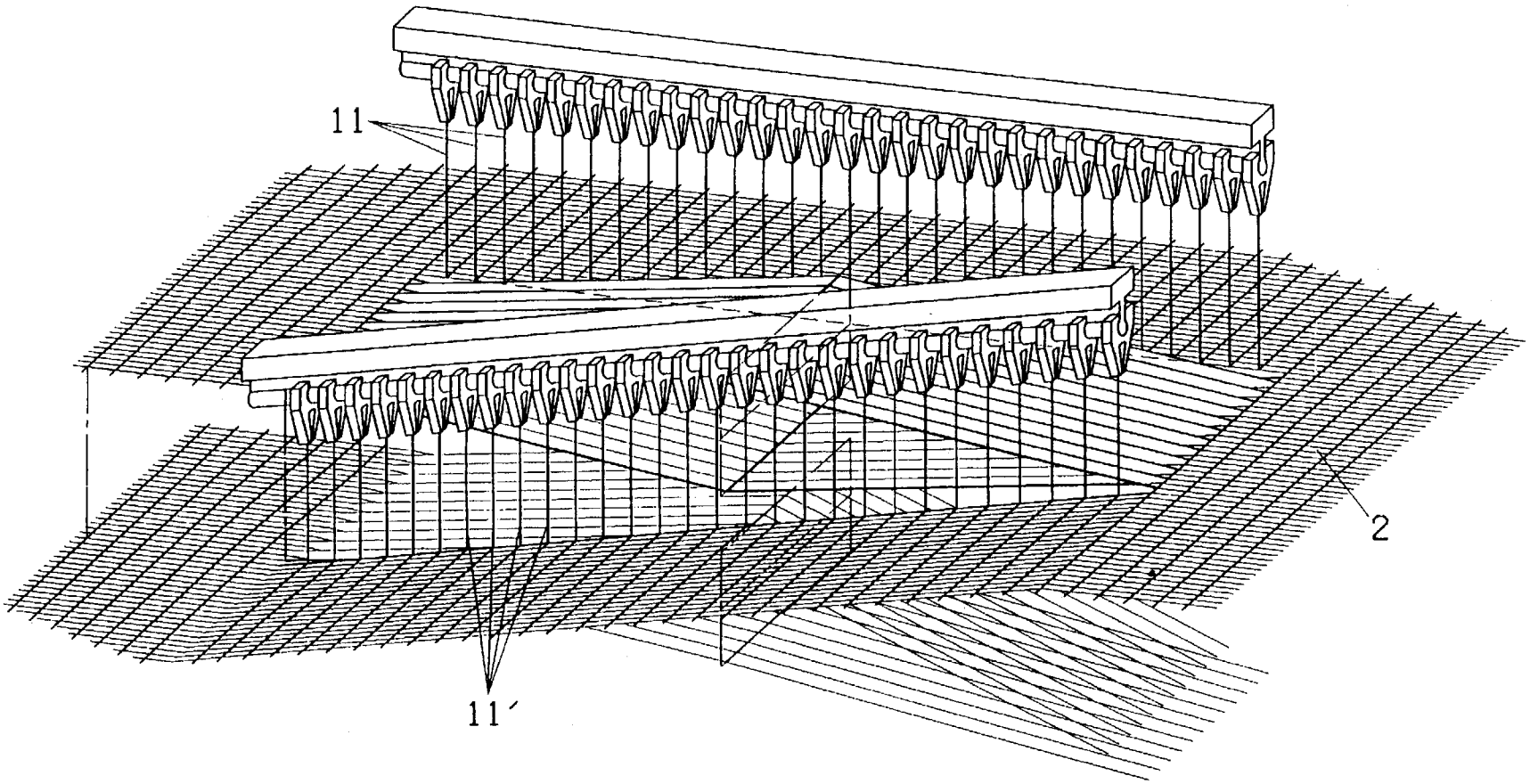
FIG. 7 shows a schematic representation for explaining the method according to the present invention in accordance with a fourth embodiment.

FIG. 7 shows a schematic representation for explaining the method for producing an endless seam 2 according to the present invention.

In principle, the method is carried out in the same way as the method shown in FIG. 6. Only the weaving-in operation described hereinbelow is different in said two methods. It follows that all the statements, which have been made in connection with FIG. 6 and which do not deal with the weaving-in operation, are analogously applicable to the present embodiment.

In contrast to the method according to FIG. 6, where the auxiliary weft threads have been woven round the central wire 41, the present method includes the step of weaving the auxiliary weft threads 11 and 11' alternately into the auxiliary warp thread group 21 used for forming the seam.

Figure 8:
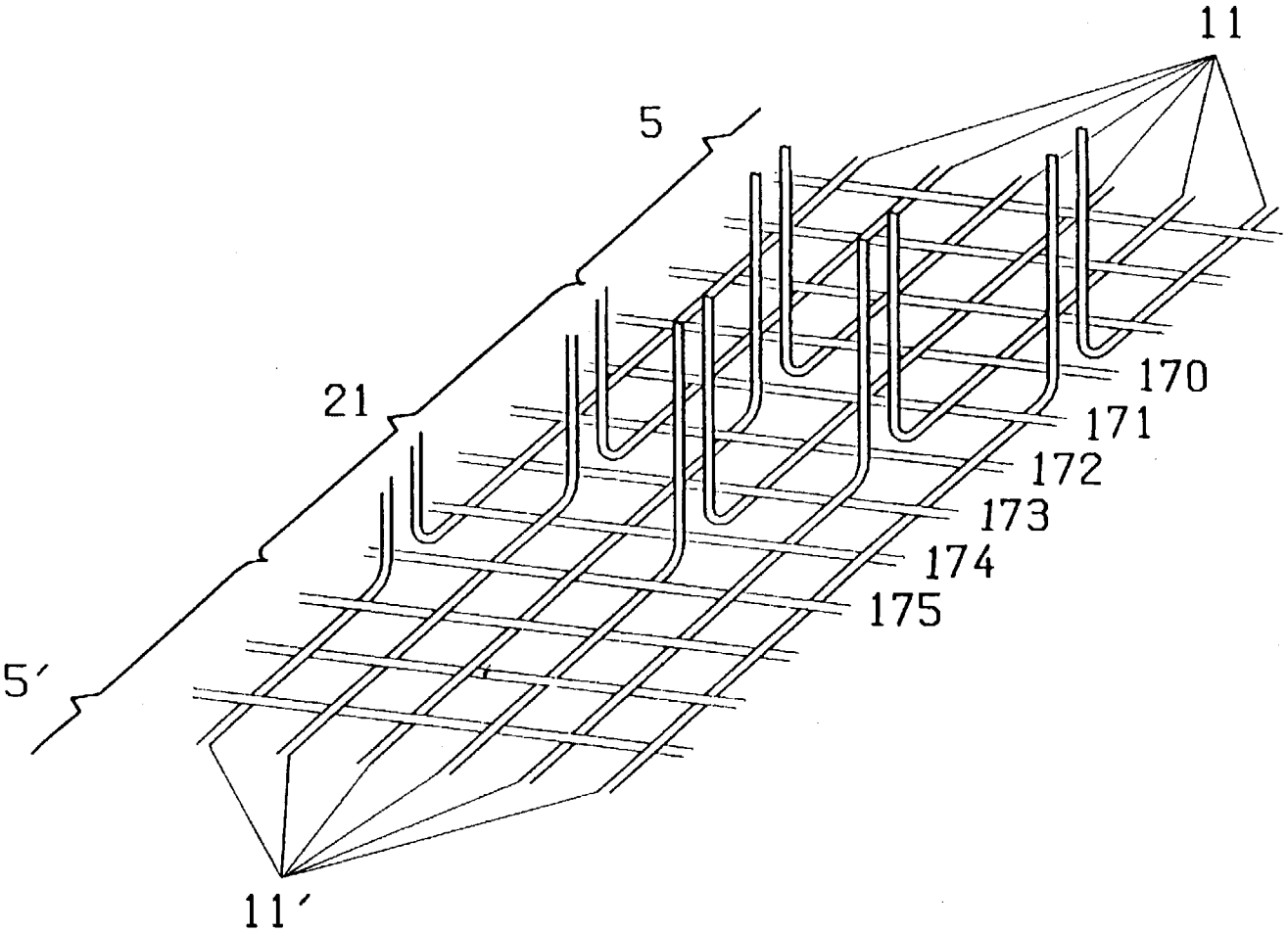
FIG. 8 shows how auxiliary weft threads are guided for producing an endless seam.

In FIG. 8, the manner in which the auxiliary weft threads are guided for this weaving-in operation is shown in detail. According to FIG. 8, the auxiliary warp thread group 21 consists of six auxiliary warp threads 170, 171, 172, 173, 174 and 175 for the purpose of illustration. In addition, the unopened woven materials 5 and 5' of the first and of the second end of the length of woven fabric as well as six auxiliary weft threads 11 and six auxiliary weft threads 11' are shown.

In a first weaving-in operation, an auxiliary weft thread 11 from the first woven fabric end is woven into the auxiliary warp thread group 21 up to a predetermined auxiliary warp thread 170 where it is guided out of the weaving plane. In the next weaving-in operation, an auxiliary weft thread 11' from the second woven fabric end is woven into the auxiliary warp thread group 21 up to the same predetermined auxiliary warp thread 170 where it is guided out of the weaving plane as well.

When the next warp thread ends 13 and 13', which still form part of the woven material, have been deposited in the deposition devices 37 and 37' in the weaving-out areas, an additional auxiliary weft thread 11 from the first woven fabric end is, in a third weaving-in operation, woven into the auxiliary warp thread group 21 up to a predetermined auxiliary warp thread 172 where it is guided out of the weaving plane. In the next weaving-in operation, the auxiliary weft thread 11' from the second woven fabric end, which corresponds to this auxiliary weft thread 11, is again woven into the auxiliary warp thread group 21 up to the auxiliary warp thread 172 where it is guided out of the weaving plane.

Also the other corresponding auxiliary weft threads 11 and 11' are woven into the auxiliary warp thread group up to a respective predetermined auxiliary warp thread 174, 171, 173 and 175 where they are guided out of the weaving plane.

According to FIG. 8, the respective corresponding auxiliary weft threads 11 and 11' are woven into the auxiliary warp thread group 21 up to different auxiliary warp threads in an advantageous manner. The above-mentioned sequence of auxiliary warp threads 170, 172, 174, 171, 173, 175, up to which the successive auxiliary weft threads are woven in, should only be regarded as an example. It is also possible to choose an arbitrary number of other sequences. On the whole, the stability of the seam area is increased by the use of various auxiliary warp threads.

Figure 9:
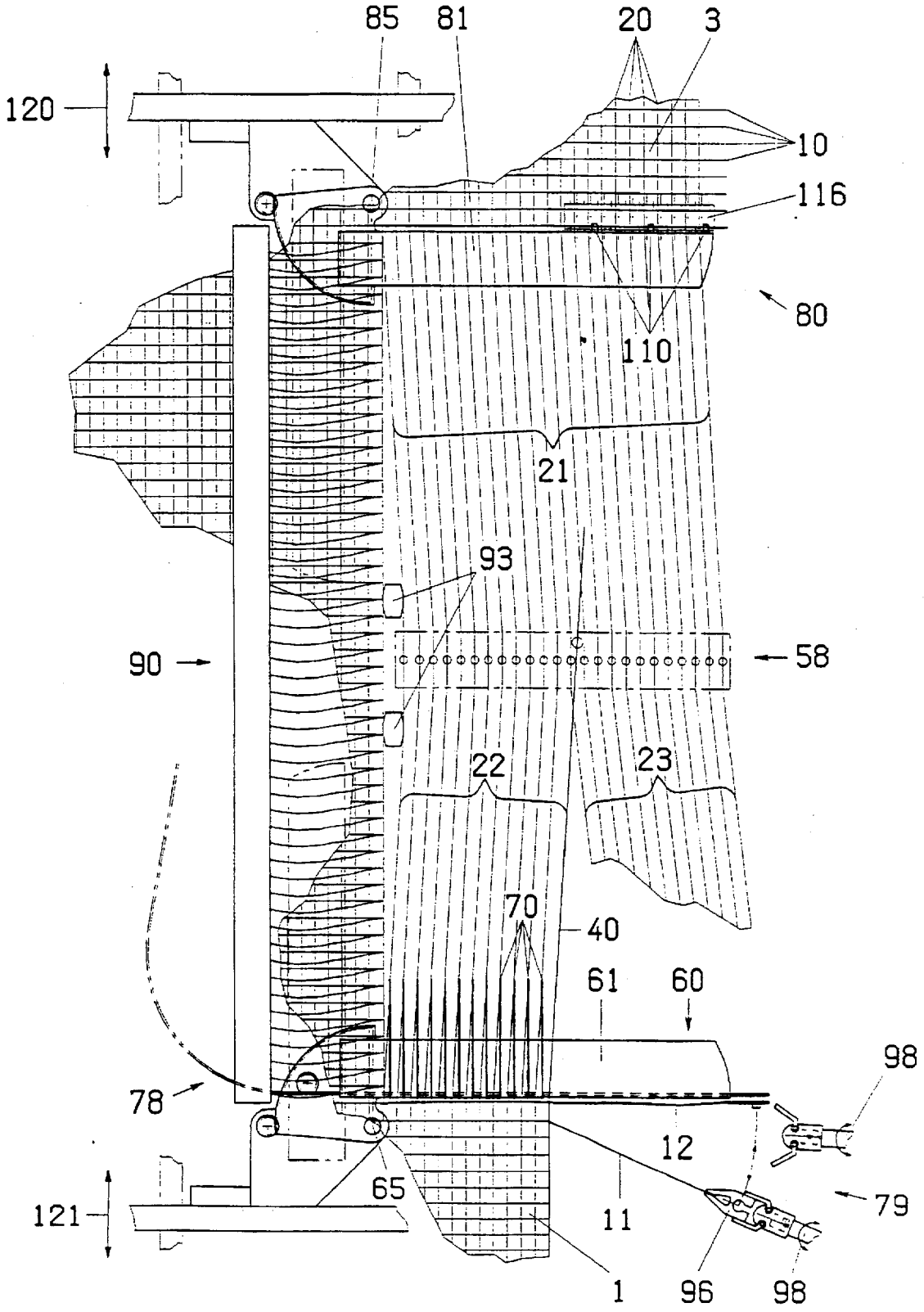
FIG. 9 shows an apparatus for mechanically producing a seam half for making a length of woven fabric endless in accordance with a fifth embodiment.

FIG. 9 shows an apparatus for carrying out the method according to the present invention, which is used for mechanically producing a seam half 1, in particular for producing a helical or spiral seam half 1 for making a length of woven fabric 3 endless. This length of woven fabric is formed of warp threads 10 extending longitudinally to the direction 8 of said length of woven fabric as well as of weft threads 20 extending transversely to said direction. In an end portion 4 of said length of woven fabric, a predetermined number of warp thread ends 11 have already been removed from the woven material by weaving out, i.e. exposed by an adequate weaving-shed position and removed from said weaving shed. These warp thread ends, which have been unwoven from the woven material, are deposited in a magazining device 90, individually and in accordance with the weaving order, as auxiliary weft threads.

The weft threads 21, which have partially been exposed by removing the warp thread ends from the woven material by weaving out, form the shed 30 which is shown in FIG. 1 and which, in the open condition, has a weaving-in area 31 and a weaving-out area 32. The various shed positions are realized by a shedding mechanism 58. As can be seen in FIG. 9, it is also possible to introduce a wire helix 40 in the weaving-in area via this shedding mechanism. Such shedding mechanisms are sufficiently known to the person skilled in the art so that a detailed description can be dispensed with. The weft threads 21 are subdivided into a first auxiliary warp thread group 22 located adjacent the non-opened woven ' material and into a second auxiliary warp thread group 23. In accordance with the method according to the present invention, the first auxiliary warp thread group 22 supplies the auxiliary warp threads required for closing the woven material. Between the two auxiliary warp thread groups 22 and 23, a wire helix 40 is supplied in the weaving-in area of the weaving shed via the shedding mechanism 58.

As has already been explained in connection with FIG. 1 to FIG. 4, the auxiliary weft threads 11 deposited in the magazining device 90 are woven into the first auxiliary warp thread group 22 in the weaving-in area 31. For this purpose, a weaving-in means 60 is provided, which comprises a weaving-in gripper 61 and a deposition device 79. The weaving-in gripper 61 is adapted to be rotated about an axle 65. At the position of the gripper shown in FIG. 9, this axle 65 extends at right angles to the length of woven fabric 3 through the non-opened woven material in the vicinity of the weaving-in area of the weaving shed. The weaving-in gripper can in this way be pivoted about this axle into the weaving-in area of the weaving shed.

In addition to this operation of pivoting in, which is carried out essentially parallel to the length of woven fabric, the weaving-in gripper can be rotated about a further axle so that it is possible to pivot said weaving-in gripper into the area of the magazining device 90 for picking up a warp thread end in this area.

In view of the fact that the magazining device 90 is arranged above the length of woven fabric 3 in FIG. 9, the weaving-in gripper 61 must be provided below said length of woven fabric so that the mode of operation thereof will not be impaired by the deposited warp thread ends 11. It is, of course, also possible to arrange said components the other way round, i.e. the gripper above the length of woven fabric and the magazining device below said length of woven fabric.

In order to enable the gripper to take up a warp thread end 11 in the area of the magazining device 90, it must be guided through the plane of the woven fabric between the first auxiliary warp thread group 22 and the non-opened woven material 5. For this purpose, the weaving-in gripper is supported by spacers 93 providing a space between the first auxiliary warp thread group 22 and the non-opened woven material.

The mode of operation of the weaving-in gripper 61 as well as the transfer of a warp thread end to the weaving-in gripper will be described in detail hereinbelow in connection with FIG. 12A to FIG. 17.

The device according to FIG. 9 includes a deposition device 79 with two gripper means 98 in the area of the end of the gripper 61 in its pivoted-in condition, each of said gripper means 98 being adapted to pick up a warp thread end 11 provided with a clip 96.

Figure 11A:
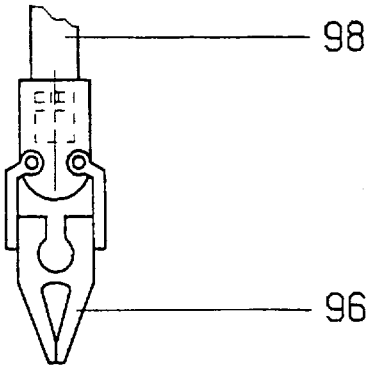
Figure 11B:
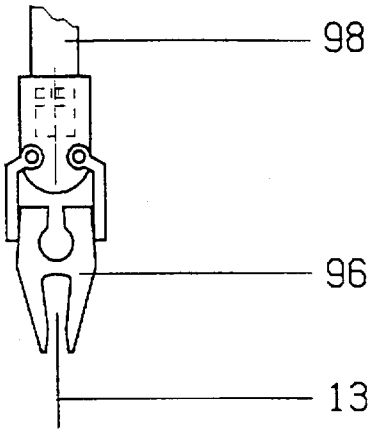
Figure 11C:
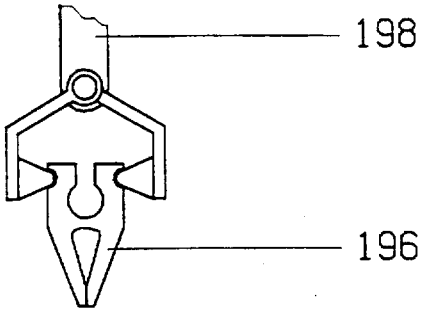
Figure 11D:
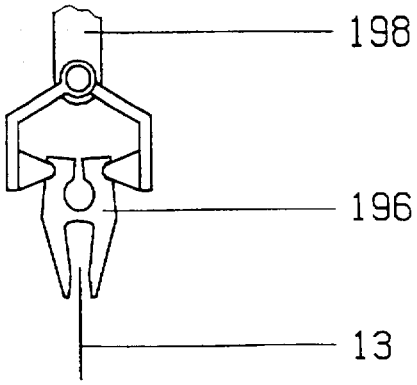

In FIG. 11A and 11B, a transfer means 98 and a clip 96 are shown in detail. The clip 96 is provided with an opening so that it can be attached to a pin of adequate shape which is provided at the end of the weaving-in gripper 61. Furthermore, the clip 96 is formed as an integral component consisting of flexible material, e.g. plastic material or metal. A transfer means 98 having a suitable structural design can take hold of the clip 96 at the lateral surfaces thereof by means of pliers having an adequate shape, whereupon the clip can be fixed in said pliers by light pressure, as can be seen in FIG. 11A. If the pressure applied to the clip by means of said pliers is increased, as can be seen in FIG. 11B, the ends of the clip will finally open and a warp thread end can be picked up or released. In FIG. 11C and 11D, an alternative embodiment of a clip 196 and of a gripper means 198 complementary to said clip are shown. In the vicinity of the round opening, the clip 196 has recesses in the lateral surfaces thereof. The gripper means 198 can engage these recesses with the aid of pliers having a suitable shape and fix the clip in said pliers by means of light pressure, as can be seen in FIG. 11C, as well as open said clip by further increasing the pressure so that a thread end 13 can be picked up or released, as can be seen in FIG. 11D.

Although only two deposition devices 79 are shown in FIG. 9, it is also possible to provide additional deposition devices, if desired. As indicated in FIG. 9 by arrows, the gripper means 98 are, furthermore, adapted to be rotated about their longitudinal axes. If desired, this rotation permits a warp thread end which has been picked up to be turned about its longitudinal axis prior to weaving back the thread.

Alternatively to the clip, it is also possible to secure an auxiliary member having a suitable shape to the warp thread end, e.g. by means of welding, by means of an adhesive or by casting in the thread end.

The apparatus according to the present invention additionally includes a weaving-out means 80 provided with a weaving-out gripper 81, which is adapted to be pivoted into the weaving-out area of the weaving shed. This gripper is adapted to be pivoted into the weaving shed about a first axle 85 extending, at the position of the gripper shown in FIG. 9, at right angles to the length of woven fabric through the non-opened portion of the woven material in the vicinity of the weaving-out area. Like the weaving-in gripper, also the weaving-out gripper is arranged below the length of woven fabric and adapted to be pivoted about a further axle so that, in the area between the first auxiliary warp thread group 22 and the non-opened woven material 5, it can be guided through the plane of the woven fabric to a point close to the magazining device for transferring there a warp thread end, which has been released from the woven material, to said magazining device 90.

The gripper arm 81 is provided with three gripper means 110. As will be described hereinbelow with regard to FIG. 19 and 20, these gripper means take hold of the next warp thread end 13 which is to be removed from the woven material by weaving out. The number of gripper means can be varied and, in particular, it can be adapted to the length of the warp thread end 13 to be removed by weaving out, in such a way that a reliable transfer of the woven-out thread to the magazining device is guaranteed. In addition, a brush 116 is provided in the vicinity of the gripper means 110, said brush supporting the seizure of the warp thread end by the weaving-out gripper. Also these means will be described more precisely hereinbelow in connection with FIG. 19 and 20.

In addition to the positions at which the weaving-in gripper and the weaving-out gripper are pivoted into the weaving shed, FIG. 9 shows, by a broken line, the positions of the two grippers in the condition in which they are pivoted out of the weaving shed.

As indicated by arrows 120 and 121, both grippers and the length of woven fabric are a adapted to be moved relative to one another along the seam to be formed. In this connection, it will be expedient when both grippers are attached to a frame (outlined by a broken line) via a holding means.

In addition, both gripper arms can have a structural design of such a nature that they will enlarge the shedding angle, i.e. the angle between the auxiliary warp threads at the weaving-in and weaving-out area. A very large stroke of the shedding mechanism, which would otherwise be necessary, can be avoided in this way.

In addition to the means shown in FIG. 9, there is, moreover, provided a control unit which temporally controls the weaving-in means, the weaving-out means and the magazining device as well as the shedding mechanism in such a way that each weaving-in operation of the respective first auxiliary weft thread 12 deposited in said magazining device 90 has associated therewith a weaving-out operation of the respective subsequent warp thread end 13 forming still part of the woven material. This control means can be of such a nature that it carries out various kinds of seams of the type explained e.g. in connection with the method described in FIG. 4. Due to the fact that, for each auxiliary weft thread 12 which has been woven in in the weaving-in area of the shed, a warp thread end 13 is removed by weaving out in the weaving-out area of the shed and deposited as auxiliary weft thread in the magazining device 90, the shed formed by the auxiliary warp threads migrates from one side of the length of woven fabric to the other side of said length of woven fabric, and in the course of this process the wire helix 40 is secured to the end of said length of woven fabric.

FIG. 9 only shows a top view of the magazining device 90. However, as can be seen from FIG. 12G and FIG. 18J, said magazining device comprises a rail 91 with a profile which is of such a nature that the clips 96 can be threaded on said rail with their openings and slidably moved along said rail. At the end facing the weaving-in area of the weaving shed, a transfer means 98 is provided. This means transfers to the weaving-in means 60 the respective clip, which has been made available at the end in question, with the auxiliary weft thread 12 to be woven in. At the end facing the weaving-out area of the weaving shed, the magazining device is provided with a transfer means 95. This means takes over a warp thread end 13, which has been removed by the weaving-out means 80, whereupon it provides said warp thread end 13 with a clip 96 and threads said clip 96 onto the rail.

By threading on this clip, all the clips which have already been threaded on are displaced in such a way that, at the end located on the side of the weaving-in area, the next clip with the next auxiliary weft thread to be removed by weaving out is made available. This has the effect that the warp thread ends are guided automatically from the weaving-out area of the weaving shed to the weaving-in area of the weaving shed. At the rail ends, means can be provided which prevent the clips from dropping off the rail inadvertently. By way of example, the ends of the rail may have attached thereto small lateral projections so that, on the one hand, a small force has to be applied by the transfer means when the pick-up and transfer operations, respectively, are carried out and so that, on the other hand, the clips are prevented from sliding off the rail unintentionally, e.g. when a warp thread end which has been removed by weaving out is transferred to the magazining device.

A prerequisite in the case of this embodiment is that the clip has the same width or is only insignificantly broader than a warp thread end. This necessitates a certain precision of the means, especially the transfer means and its control, so that a reliable transfer of the warp thread ends to the magazining device is guaranteed.

These demands can be reduced by providing a further rail having e.g. the same length as and extending parallel to the first rail. In this case, the clips could be twice as broad as the warp thread ends. The control for the transfer means means would, however, be more complicated, since the first and the second rail would have to be accessed alternately. It would, of course, also be possible to use more than two rails; this would reduce the requirements to be met by the precision of said means still further, but the structural design and the control of said means would become more complicated.

FIG. 9 additionally shows a device 70 for beating up the warp thread end 13, which has been introduced in the weaving shed. In addition, the weaving-in means 60 is provided with a tape gripper 78. The device 70 as well as the tape gripper 78 will be explained in detail hereinbelow in connection with the weaving-in means 60.

Figure 10:
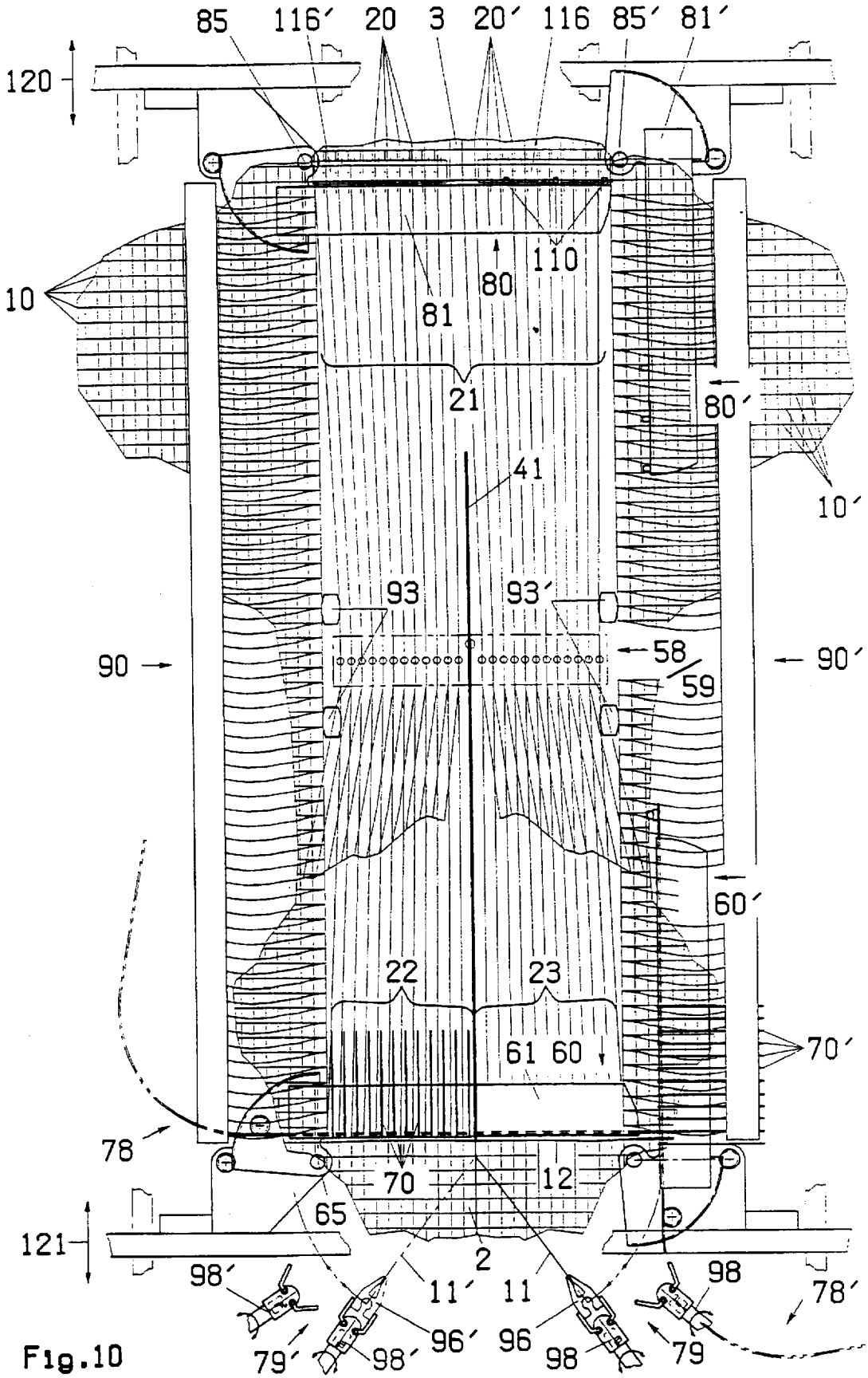
FIG. 10 shows an apparatus for mechanically producing a seam for making a length of woven fabric endless in accordance with a sixth embodiment, FIG. 11A to lid show details of various embodiments of the deposition device shown in FIG. 9 and FIG. 10, FIG. 12A to 12I show details of the weaving-in means, which has been shown in FIG. 9 and 10, for explaining the mode of operation of said weaving-in means.

FIG. 10 shows an apparatus for carrying out the method for producing a pin seam 2 for making a length of woven fabric 3 endless. This method was described in connection with FIG. 6. In this embodiment, the two ends 4 and 4' of a length of woven fabric 3 are releasably interconnected by weaving threads round a central wire 41 alternately from the two ends of said length of woven fabric. Analogously to the methods described in FIG. 1 to 3 and the apparatus shown in FIG. 9, a shed 30 is here inserted into one end portion 4 of the length of woven fabric 3. In the area 4 of the length of woven fabric, the structural design of the present apparatus differs from that of the apparatus shown in FIG. 9 only insofar as the second auxiliary warp thread group 23 is also used for forming the seam and insofar as a central wire 41 instead of the wire helix 40 is supplied by the shedding mechanism 58. It follows that, for describing the other components in this first end portion 4, reference is made to the description of FIG. 9.

In order to permit the warp thread ends 11', part of which has already been removed from the woven material by weaving out and deposited in a magazining device 90' and which are required for weaving the central wire into the second end 4' of the length of woven fabric 3, to be removed from the woven material of the second end portion 4' by weaving out, an auxiliary shedding mechanism 59 is provided in the apparatus according to FIG. 10. The auxiliary shedding mechanism uses a group of weft threads 21' of the second end portion 4' of the length of woven fabric as auxiliary Warp threads for forming an auxiliary weaving shed 33 with the aid of the mechanism 59 (cf. FIG. 6). As can be seen from FIG. 6, these weft threads 21' are located below the weaving plane, and, consequently, they are not shown in FIG. 10. In view of the fact that the auxiliary warp threads 21' are not used for forming the seam, said auxiliary weaving shed only has a weaving-out area 34 (cf. FIG. 6). Analogously to the weaving-out area 32 of the shed 30, a weaving-out means 80' is adapted to be pivoted into this weaving-out area. This weaving-out means includes a gripper 81', which is shown at the position at which it is not pivoted into the shed 30, and a brush 116'. The only difference between the weaving-out means 80' and the weaving-out means 80 is that said means 80' and 80 have mirror-inverted structural designs. The modes of operation of these two means are completely identical.

Accordingly, a gripper 81', which is shown in FIG. 10 at the position at which it is removed from the auxiliary weaving shed 59, picks up the next warp thread end 13' following in the woven material at a suitable position of the shed. The gripper 81' is pivoted out of the auxiliary weaving shed and guided into the area of the magazining device 90', where the warp thread end 13', which has been removed by weaving out, is deposited as auxiliary weft thread.

Analogously to the magazining device 90, the magazining device 90' serves to guide the deposited warp thread ends 11' into the area of a weaving-in means 60', where they are taken over by said weaving-in means and woven into the auxiliary warp threads 21 in the end portion 4 of the length of woven fabric so as to form the seam. In view of the fact that the warp thread ends 11 and 11' are removed by weaving out in different planes (cf. also FIG. 6), this must be taken into account upon constructing the rail 91' of the magazining device 90'. The rail must, in particular, be provided with a stopper at the lower end thereof so that warp thread ends 11' which have already been deposited will not drop off the rail due to the force of gravity.

For weaving in the auxiliary warp threads 11', a second weaving-in means 60' is provided in the weaving-in area 31 of the shed 30, said second weaving-in means 60' taking over the auxiliary weft thread 12' to be woven in and weaving said auxiliary weft thread into the auxiliary warp threads 21. This weaving-in means 60' corresponds to the weaving-in means 60 as far as its structural design is concerned. Like in the case of the weaving-out means, the only difference existing between said means 60' and said means 60 is that they have mirror-inverted structural designs. It follows that also in this case the description of the weaving-in means 60 can be referred to.

Analogously to the apparatus according to FIG. 9, a control unit (not shown) is also provided for the present apparatus. This control unit is of such a nature that a temporal control of the two weaving-in means, the two weaving-out means and the two magazining devices as well as of the shedding mechanism and the auxiliary shedding mechanism is carried out in such a way that auxiliary weft threads 12 and 12', respectively, from the first and second magazining devices are used alternately for the weaving-in operation and that each weaving-in operation carried out by the first and second weaving-in means 60 and 60', respectively, has associated therewith a weaving-out operation carried out by the first and second weaving-out means 80 and 80', respectively. It goes without saying that this control unit can also be used for realizing in connection with the method described in FIG. 4 the various kinds of seams explained in the figures.

The shedding mechanism 58 and the auxiliary shedding mechanism 59 can be coupled so that only one control will be required. When the shed positions of the weaving' shed and of the auxiliary weaving shed correspond, both weaving-out grippers 81 and 81' can be activated simultaneously so that time will be saved due to the fact that the warp thread ends 11 in the first end portion 4 and the warp thread ends 11' in the second end portion 4' are simultaneously removed by weaving out.

The apparatus described in FIG. 10 can also be used for producing an endless seam according to the methods described in connection with FIG. 7. For this purpose, it will only be necessary to adapt the control unit in such a way that both weaving-in means, both weaving-out means and both magazining devices as well as the shedding mechanism and the auxiliary shedding mechanism are controlled in such a way that auxiliary weft threads 12 and 12', respectively, from the first and second magazining devices 90 and 90', respectively, are alternately used for the weaving-in operation and that the weaving-in and weaving-out operations performed by the first weaving-in means 60 and the first weaving-out means 80, respectively, as well as the weaving-in and weaving-out operations performed by the second weaving-in means 60' and the second weaving-out means 80', respectively, are carried out alternately. Neither the means used for supplying the central wire 41 nor the deposition devices 79 and 79' are required for carrying out this method. It follows that, if the apparatus is only intended to be used for producing an endless seam, it will not be necessary to provide these means/devices.

In view of the fact that the apparatus according to FIG. 10 includes all the components of the apparatus according to FIG. 9, said apparatus according to FIG. 10 is also adapted to be used for producing seam halves in accordance with the methods described hereinbefore. Also for this purpose, the control unit will have to be adapted in an adequate manner.

When the apparatus according to FIG. 10 is provided with a programmable control unit, said apparatus can, consequently, be used for producing helical seam halves, pin seams as well as endless seams. When the shedding mechanism 58 is constructed such that an additional wire helix is made available in the area in which the first wire helix 40 is supplied, it will, moreover, be possible to produce two helical seam halves simultaneously. The individual components of the apparatus can, of course, also be arranged in such a way that, if desired, they can be removed from the apparatus if they are not required for producing a specific type of seam and make the use of said apparatus more difficult, e.g. upon inserting the weaving sheds.

Making reference to FIG. 12A–17, the weaving-in means 60 and 60', which have been used in the above-described apparatuses, will be explained hereinbelow.

FIG. 12A to 12I show the various positions of the weaving-in gripper 61, which are necessary for taking over the warp thread end 12 from the magazining device and for weaving in said warp thread end as an auxiliary weft thread into the auxiliary warp threads 21 of the weaving shed.

Figure 12A:
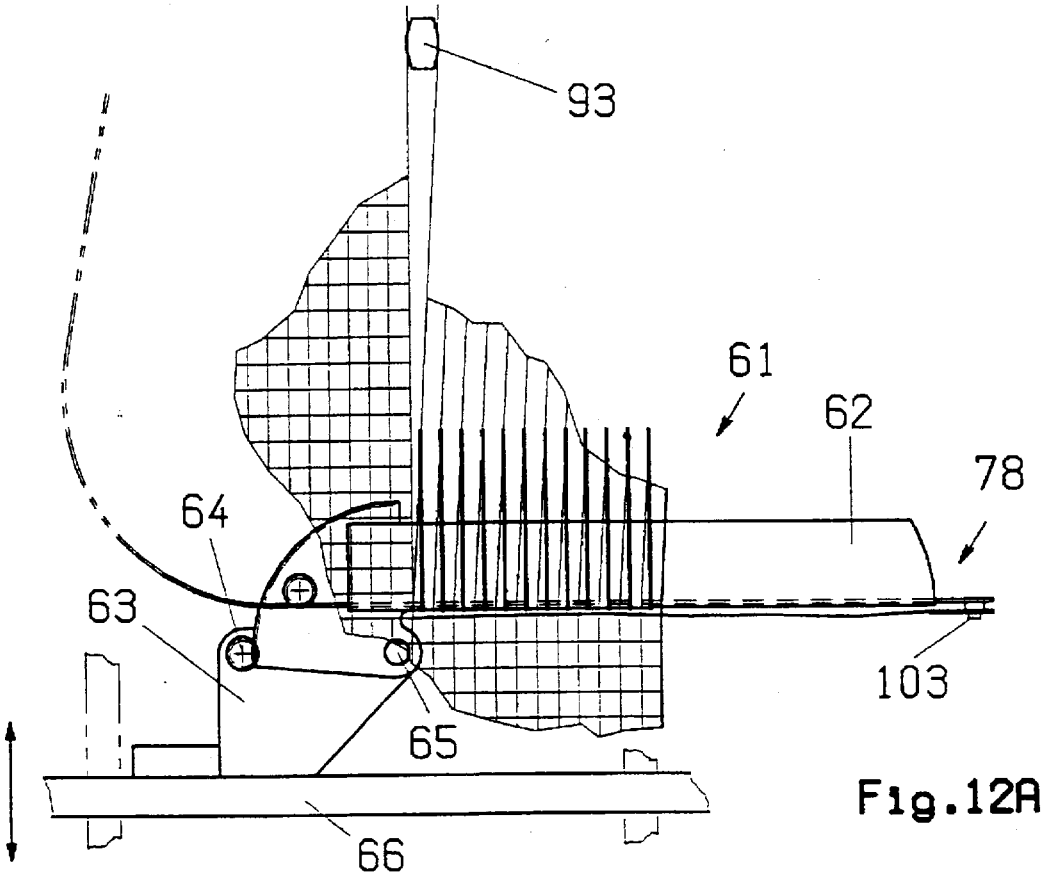
Figure 12B:
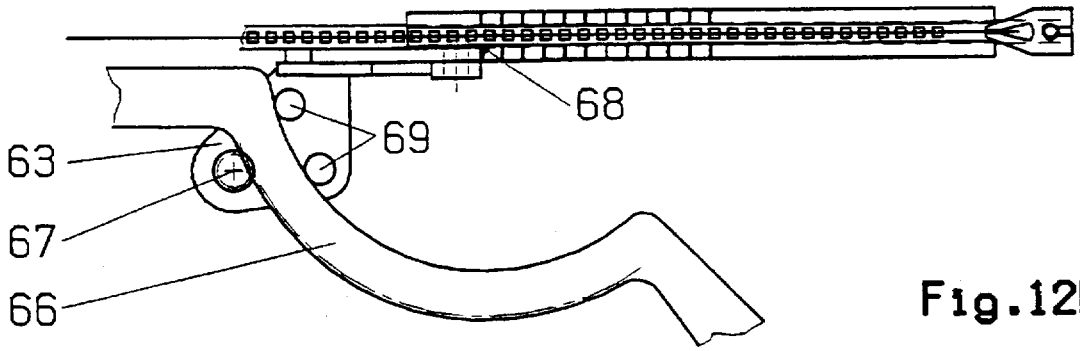
Figure 12C:
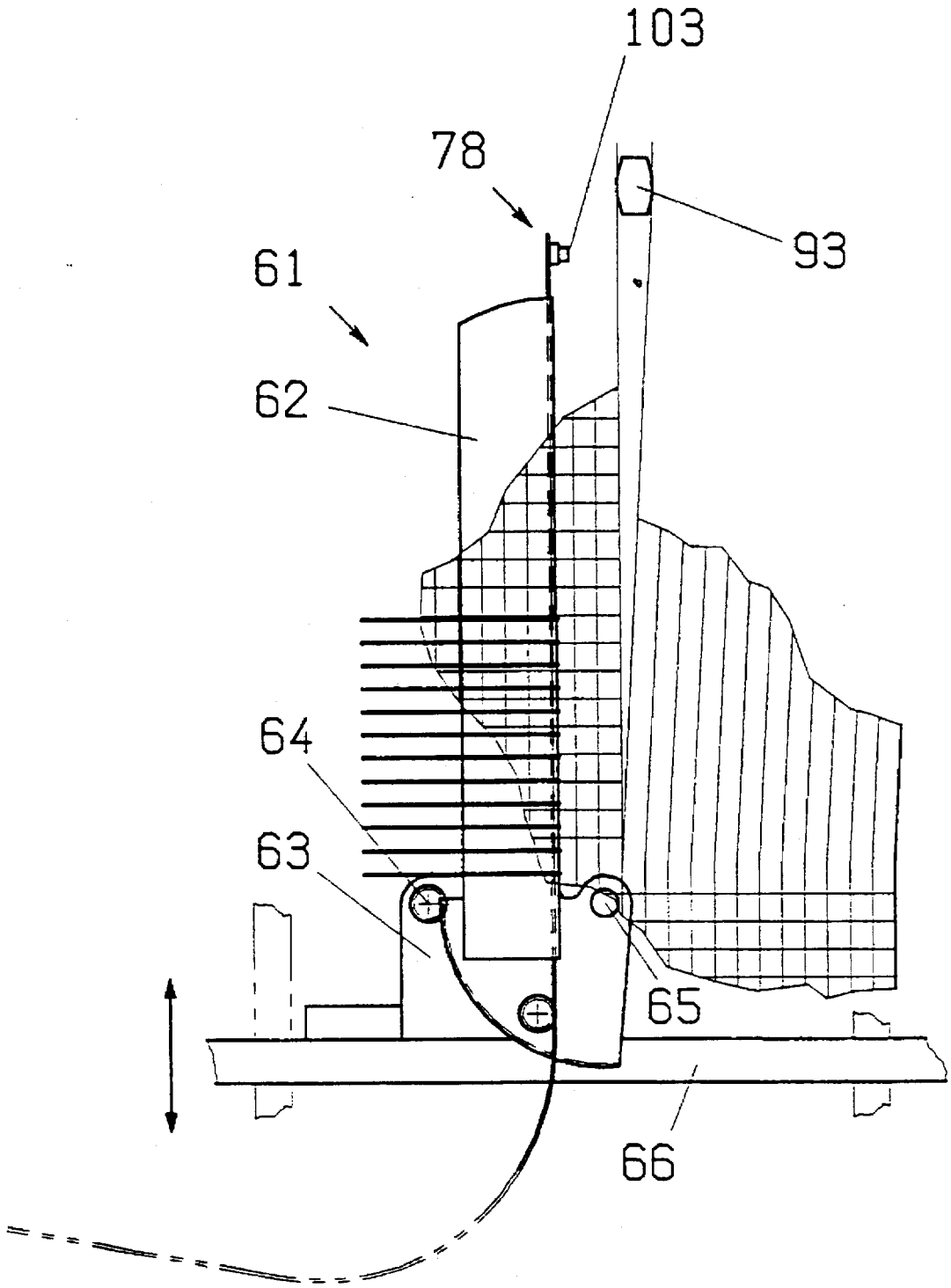

FIG. 12A shows the weaving-in gripper 61 at the position at which it is pivoted into the weaving-in shed. In FIG. 12B, a side view of the weaving-in gripper at the same position is shown. This gripper has a gripper arm 62, which is secured to a first holding device 63 such that it is adapted to rotated about a first axle 65. As can be seen from FIG. 12A and 12B, the first holding device 63 includes in the present embodiment two plates, which are arranged one on top of the other such that they extend at right angles relative to one another and which are fixedly secured to one another. The first axle 65 extends essentially at right angles to a first one of these two plates. With the aid of a first drive means 64, the gripper arm 61 can be rotated about the axle 65 relative to the holding device. The drive means 64 can be provided in the form of a drive wheel. This drive wheel is then in frictional engagement with a running surface of the gripper arm, said running surface having, when seen in a cross-sectional view, the shape of a bow whose centre lies in the first axle.

Alternatively, it is also possible to provide teeth on the gripper arm, said teeth being engaged by a gear which is adapted to be driven.

On the second plate of the holding device, a drive means 67 is provided. As can be seen from FIG. 12B, this drive means fulfills two tasks. On the one hand, it secures, in its non-driven condition, the first holding device to an arcuate rail of a second holding device 66 in cooperation with two rollers 69. On the other hand, the drive means 67 moves.(in its driven condition) the first holding device along said arcuate rail. Analogously to the first drive means, it is again possible to use a drive wheel which is in frictional engagement with an arcuate running surface of the second holding device, a gear which engages suitable teeth on the second holding device, or a similar device.

The rollers 69 act on the side of the arcuate rail of the second holding device 66 which is located opposite the running surface. This has the effect that the rail is encompassed by the drive wheel (gear) and by the two rollers of the first holding device 63, and the first holding device is, in the non-driven condition of the drive means, held relative to the second holding device. It is, of course, also possible to provide one drive wheel and one roller on one side of the rail and one roller on the other side of the rail. A plurality of drive wheels and one or several rollers can be used as well.

By selectively controlling the two drive means, the gripper arm can, on the one hand, be pivoted into and out of the weaving shed, and, on the other hand, it can be moved through the weaving plane into the vicinity of the magazining device where it will take over the next auxiliary weft thread to be woven in.

If, for example, the gripper arm is to be moved from the condition in which it is inserted in the weaving shed (FIG. 12A) to a point in the vicinity of the magazining device (FIG. 12F), the following control operation will be necessary.

Figure 12D:
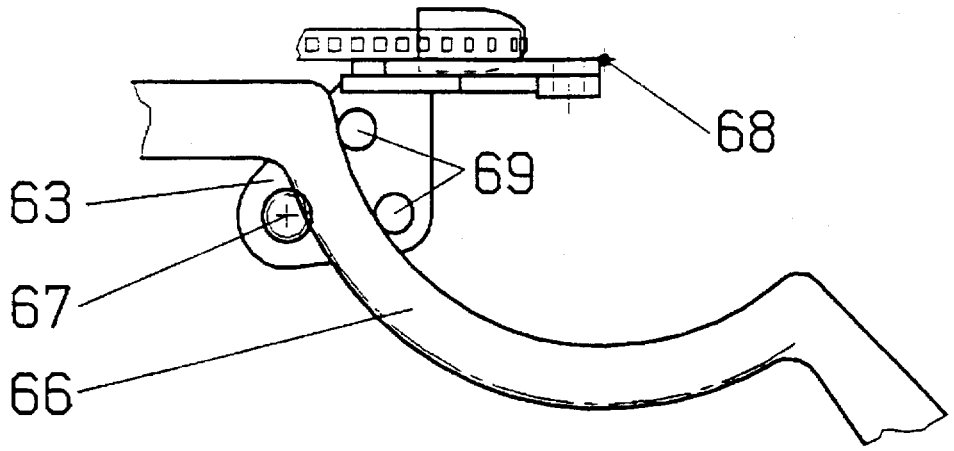
Figure 12E:
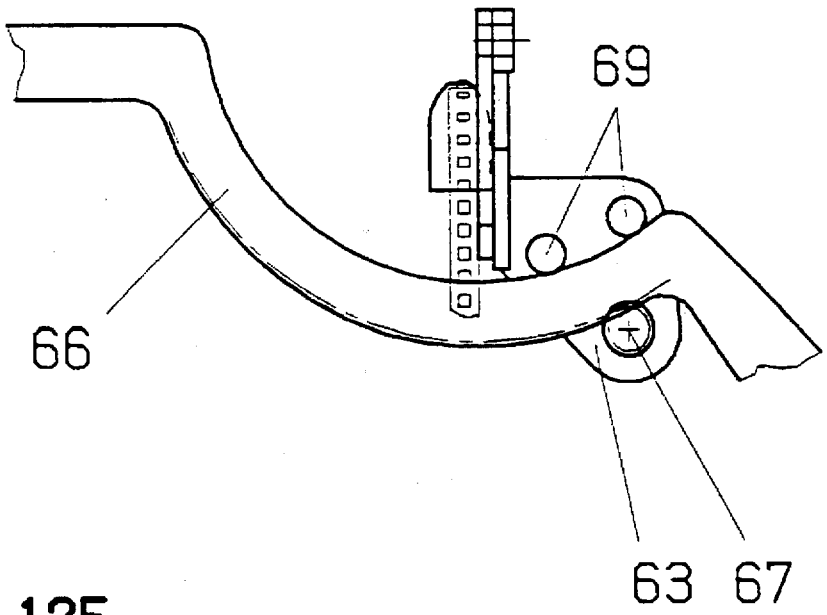

Taking as a basis the position shown in FIG. 12A, the gripper arm is rotated anticlockwise about the first axle 65 by 90° relative to the first holding device 63 by actuating the first drive means 64. The gripper arm will then occupy the position shown in FIG. 12C (top view) and 12D (side view). In view of the fact that the gripper is located below the woven fabric at this position, it must be rotated such that it is located below the space between the auxiliary warp threads and the non-opened woven material prior to being passed through said space. For this purpose, the second drive means 67 is actuated whereupon the first holding device 63 will be moved along the arcuate rail of the second holding device 66 in such a way that the gripper in FIG. 12D is rotated anticlockwise by 90° about an axle 68 extending parallel to its longitudinal axis. The position occupied by the gripper after this rotation is shown in FIG. 12E. At this position, the gripper arm is located below the space between the auxiliary warp threads 21 and the non-opened woven material 5 (cf. FIG. 9). By actuating the first drive means 64 again, the gripper is now rotated clockwise about the axle 65 by 90° (when viewing the gripper from the top analogously to FIG. 12A). By means of the last rotation, the gripper is guided through the space between the non-opened woven material and the auxiliary warp thread group to the position shown in FIG. 12F. In order to prevent the gripper arm from getting entangled in one of the auxiliary warp threads, a spacer 93 can be provided. At this position shown in FIG. 12F, the weaving-in gripper can take over a warp thread end from the magazining device.

After having taken over a warp thread end, the gripper can be controlled such that the steps described hereinbefore will be carried out in reverse order and that, consequently, the gripper with the warp thread end will be guided into the weaving-in area of the weaving shed. The warp thread end can then be woven into the woven material in a manner which will be described hereinbelow.

In the present embodiment, the two rotating axles 65 and 68 extend at right angles to one another. It follows that the rotations carried out are always 90° rotations. This is, however, not necessary. The axles may also include a different angle. In this case, the rotations would have to be adapted to this angle in such a way that the various positions of the gripper can be taken up.

For the purpose of transferring the warp thread end to the weaving-in gripper, a transfer means 98 is provided. This transfer means has the same features as the deposition device 79, which has been described in connection with FIG. 9 and shown in detail in FIG. 11A to 11D. It follows that a detailed description of the features of this means is not necessary.

Figure 12F:
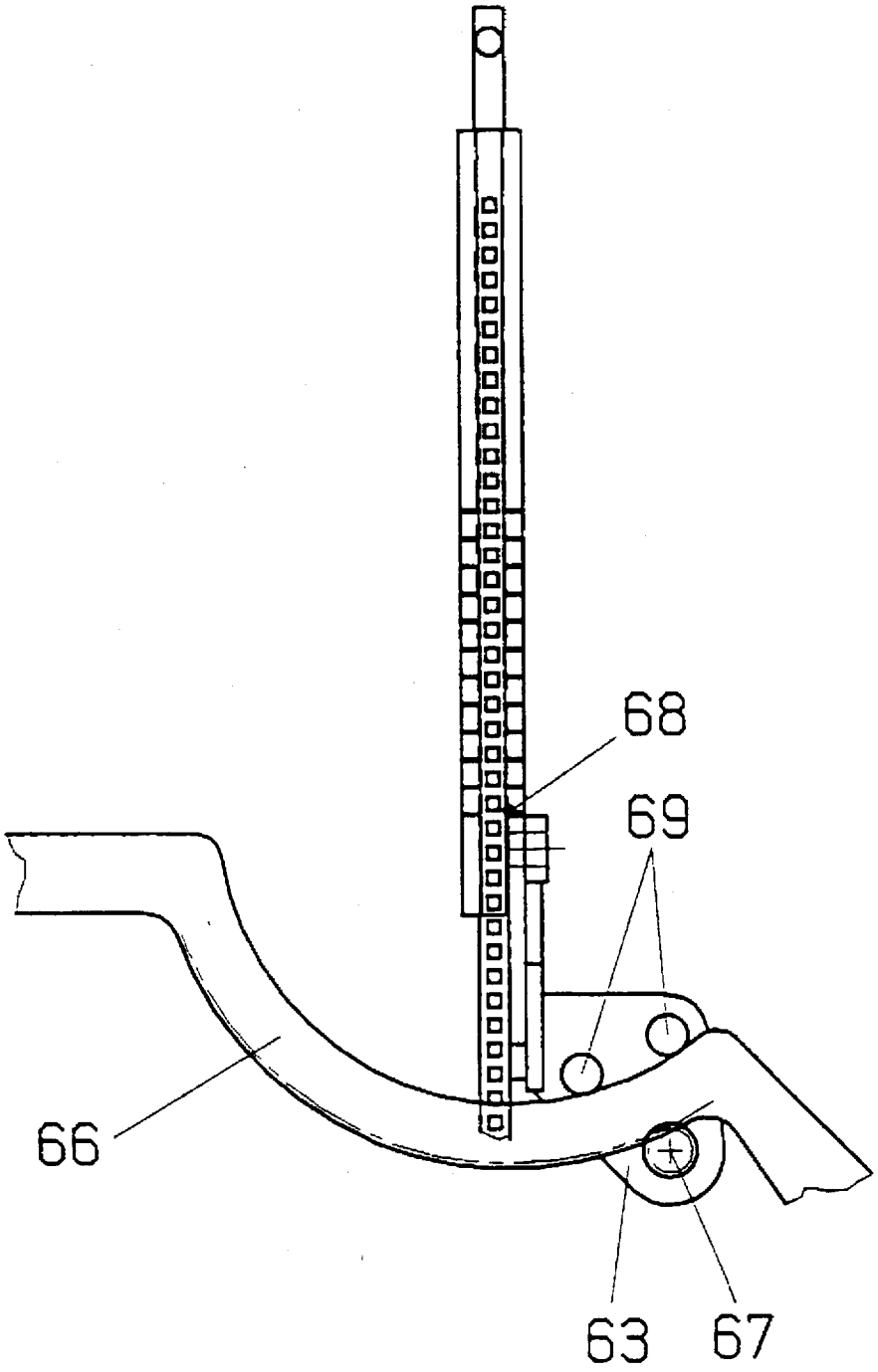
Figure 12G:
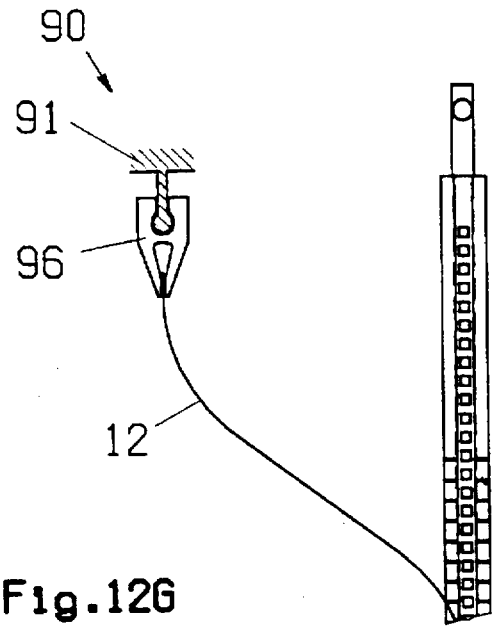
Figure 12H:
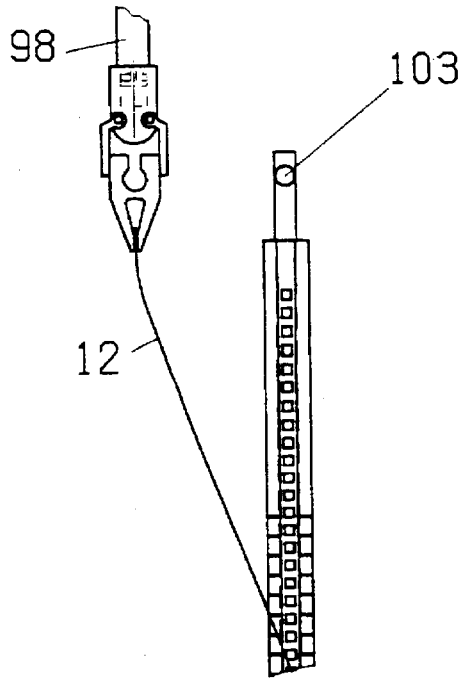
Figure 12I:
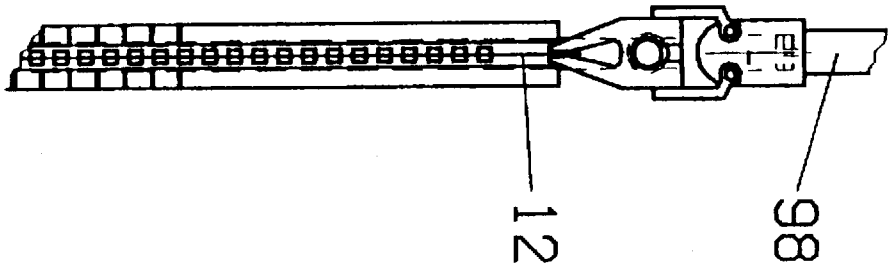

In FIG. 12G to 12I, the steps which have to be carried out for transferring a warp thread end 12 to the weaving-in gripper 61 are shown. In FIG. 12G, the warp thread end 12 to be transferred to the weaving-in gripper 61, which occupies the position shown in FIG. 12F, is still in the magazining device 90. The warp thread end is provided with a clip 96 for the purpose of transfer. This clip is threaded onto a profile rail 91 of the magazining device with the aid of its opening, said profile rail being complementary to said opening. Making use of pliers having an adequate shape, the transfer means 98 takes hold of the clip and fixes said clip 96 by means of light pressure applied by said pliers. The clip can now be removed from the profile rail in the longitudinal direction. As can be seen in FIG. 12H, the warp thread end is then guided to the weaving-in gripper with the aid of the tranfer means 98. The transfer means 98 then attaches the clip with the aid of its opening to a complementary pin 103 of the tape gripper 78. This pin can be seen in the top view of the tape gripper in FIG. 12A. The weaving-in gripper 61 having attached thereto the clip 96 is shown in FIG. 12T. Finally, the pliers of the gripper means are opened again and the warp thread end seized by the weaving-in gripper by means of the clip 96 can be woven into the woven material by adequately controlling the two drive means of the weaving-in gripper at a suitable position of the shed.

The weaving-in operation of an auxiliary weft thread 12 will be explained in detail hereinbelow making reference to FIG. 13.

Figure 13:
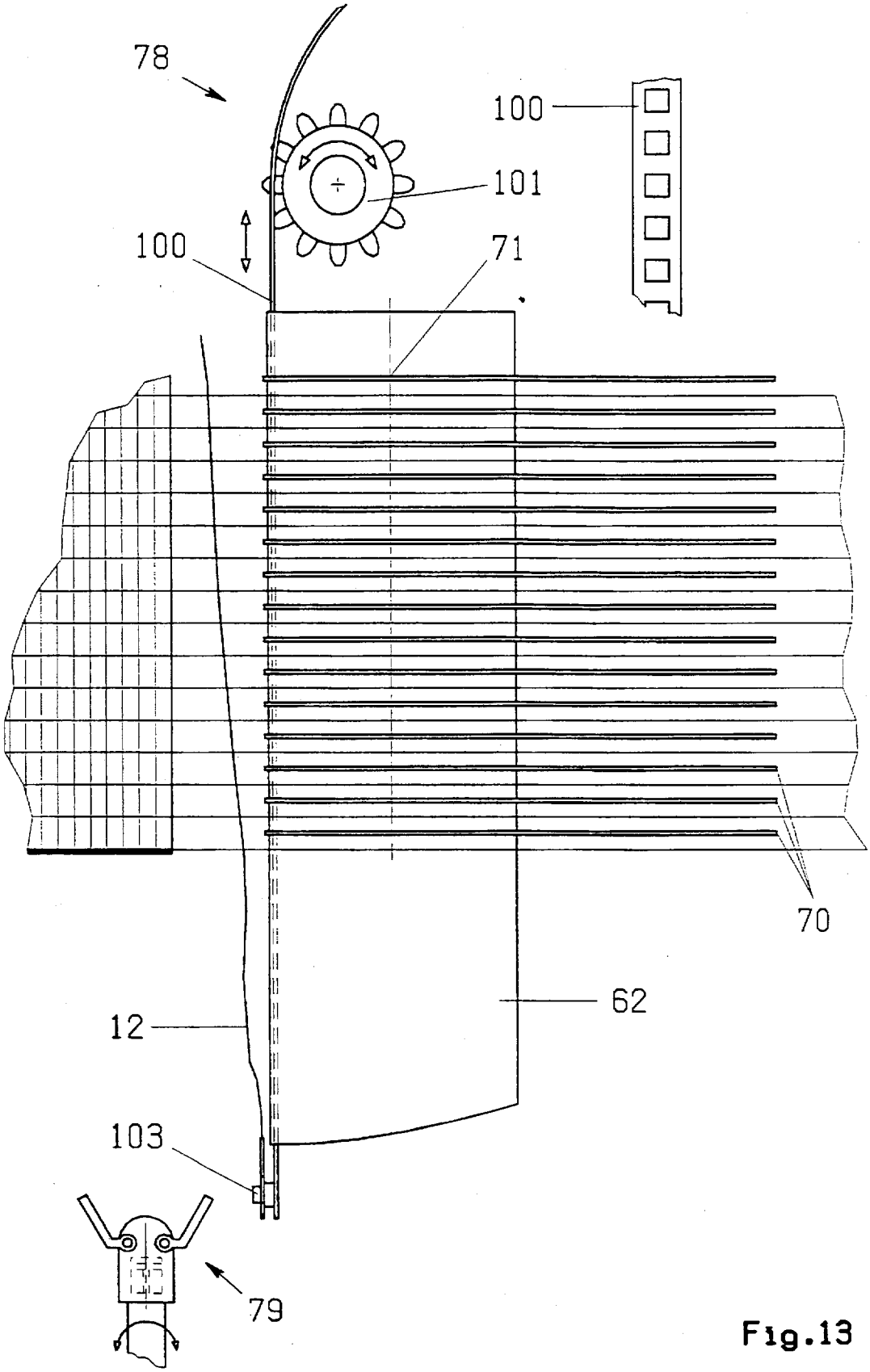
FIG. 13 shows a detail of the weaving-in gripper shown in FIG. 12A to 12I, FIG. 14A to 14C show various positions of a lamella of the weaving-in gripper, which is shown in FIG. 13, at different times.

In the embodiment shown in FIG. 13, the weaving-in gripper 61 is provided with a tape gripper 78. This tape gripper comprises a tape 100, which is adapted to be moved in a guide means of the gripper arm 62 along the longitudinal axis of said gripper arm by means of a tape drive 101. According to FIG. 13, said tape is provided with rectangular openings which are adapted to be engaged by a driving gear 101 with suitable teeth. It is, of course, also possible to use other drive mechanisms for the tape 100.

The tape drive comprising the driving gear can be provided on the holding element for the gripper as well as directly in said gripper.

At the end of the tape 100, a pin 103 is provided whose diameter is dimensioned such that the clip 96, which fixedly holds the auxiliary weft thread 12 to be woven in, can be attached to said pin with the aid of its opening.

Figure 14:
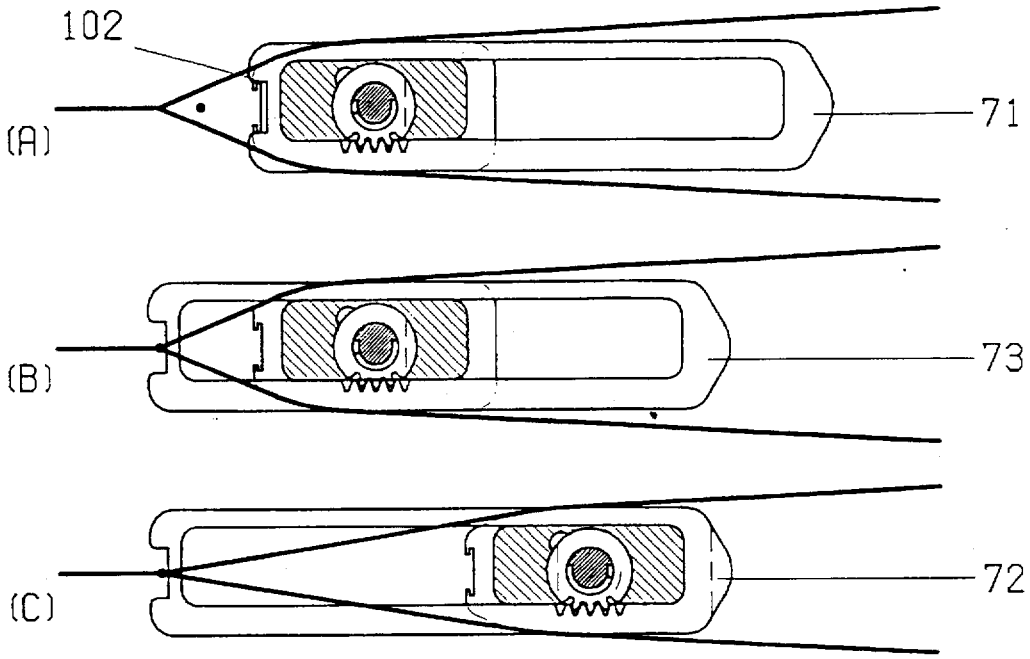
Figure 15:
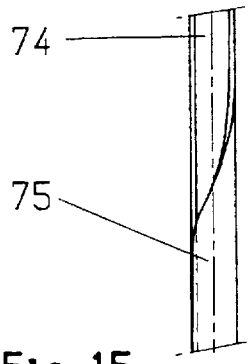
FIG. 15, 16 and 17 show details for explaining a lamella control for the weaving-in gripper shown in FIG. 13, FIG. 18A to 18J show details of the weaving-out means, which is shown in FIG. 9 and FIG. 10, for explaining the mode of operation of said weaving-out means.

Furthermore, the weaving-in gripper is provided with a plurality of lamellae 70, which are adapted to be displaced essentially at right angles to the gripper axis from a first position 71 shown in FIG. 13 via a second position 73 to a third position 72. In FIG. 14*a*, *b* and *c*, the first, the second and the third positions are shown. By displacing the lamellae to the second position 73, the thread 12 introduced in the weaving shed can be beaten up. At the first position, the tape 100 is adapted to be guided through the lamellae 70 of the gripper arm. The lamellae 70 and especially the control thereof will be described hereinbelow in detail in connection with FIG. 14 to 17.

In FIG. 13, the weaving-in gripper with the auxiliary weft thread 12, which is to be woven in and which has been transferred from the magazining device in accordance with the description according to FIG. 12A and 12I, has already been guided in the weaving-in area of the shed at a suitable position of the shed.

In said weaving-area, it is taken over by the deposition device 79. In the next step, the tape 100 is removed from its guide means 102 (FIG. 14) in the gripper arm by actuating the drive 101. The auxiliary weft thread 12 introduced in the weaving shed can then be beaten up by displacing the lamellae 70 to their second position 73.

When the thread 12 has been beaten up, the gripper arm 61 is pivoted out of the weaving shed so that the shedding mechanism 58 can adjust the position of the shed for weaving back or, if the auxiliary weft thread 12 has temporarily been deposited, for weaving in an additional auxiliary weft thread. During this pivoting process, the lamellae remain at a position at which they abut on the beaten-up auxiliary weft thread so as to prevent bouncing back of the thread until they have reached their final position relative to the gripper arm, i.e. the third position 72, and until the shed angle, i.e. the angle between the upper and lower warp threads, has been reduced by the pivoting-out movement of the gripper to such an extent that the bent or cranked auxiliary warp threads hold the auxiliary weft thread which has just been inserted until said auxiliary weft thread is finally incorporated into the woven fabric of the seam by the next shed formation.

When this shed position has been taken up, the lamellae are moved to their first position and the gripper arm 62 is reintroduced into the weaving shed and, subsequently, the tape 100 is reinserted into its guide means 102 in the gripper arm so that the auxiliary weft thread 12 deposited in the deposition device 79 together with the clip 96 is again transferred to the weaving-in gripper by attaching it to the pin 103.

In accordance with the position of the shed, the auxiliary weft thread 12 is woven into the auxiliary warp threads by withdrawing the tape 100 of the tape gripper 78 from the gripper arm 62, whereupon said auxiliary weft thread 12 is beaten up by displacing the lamellae to their second position. Subsequently, the gripper arm is again guided out of the weaving shed in the manner described hereinbefore.

Following this, the clip 96 can be removed from the pin 103 by suitable means, e.g. a means corresponding to the gripper means 98, and the clip 96 can be detached from the auxiliary weft thread 12. In this description of the weaving-in operation of the auxiliary weft thread 12, it has not been taken into account that, between the individual steps, it is also possible to carry out other steps, which have nothing to do with the weaving-in operation, such as the removal of a warp thread end etc..

In the following, the control of the lamellae 70 will be described making reference to FIG. 14 to 17.

FIG. 14 shows one of the lamellae 70 at its first position 71 and at its second position 72. As has already been explained, the tape 100 of the tape gripper 78 can be guided through the lamellae along the gripper arm at said first position. For this purpose, a guide means 102 has been provided. From its first position, the lamella 70 can be displaced to a second position, whereby a weft thread 12 introduced in the weaving shed can be beaten up. According to FIG. 17, all lamellae are displaced by one control. For this purpose, a shaft 74 with a groove 75 is provided in the gripper arm 62. As can be seen from FIG. 15, said groove 75 has a first longitudinal side extending essentially parallel to the shaft and a second longitudinal side in the form of a curve.

The groove of the shaft can also be defined by two curve-shaped longitudinal sides or by two straight longitudinal sides extending at different angles relative to the longitudinal axis. The groove must, however, be constructed such that a groove width is obtained, which varies along the axis of rotation in a defined manner.

This shaft has provided thereon two rotatably arranged control elements 76 for each lamella to be displaced. The control elements 76 engage the groove 75 of the shaft 74 via a carrier. According to their positions along the shaft, the control elements 76 associated with the various lamellae engage the shaft with various amounts of play.

When all carriers have been brought into contact with the parallel longitudinal side of the groove, said carriers will successively contact the longitudinal edge along the shaft, when the shaft is rotated towards the curve-shaped longitudinal side, and, after having been brought into contact, they will be entrained by the shaft. If the shaft is, however, rotated towards the parallel longitudinal side of the groove, the control elements will be moved in the opposite direction, when the carriers have been brought into contact with said groove.

For transmitting the movement of the control elements 76 to the lamellae 70, a transmission element 77 is arranged for each lamella to be displaced, said transmission element 77 being provided between two control elements 76 and being adapted to be rotated on the shaft 74. This transmission element is, on the one hand, drivingly connected to the lamella. As can be seen in FIG. 14, the transmission element can, for this purpose, be constructed in the form of a gear which engages teeth of the lamella. It is, of course, also possible to use other transmission mechanisms; the transmission element 77 can, for example, be provided in the form of a wheel rolling on a running surface which is arranged on the lamella. On the other hand, said transmission element 77 is connected to the control elements 76 by a frictional connection. The frictional connection between said elements 76 and 77 will be released when both elements are acted upon by a force which exceeds the frictional force produced by the frictional engagement.

It follows that this connection will be released when, on the one hand, the lamella has already beaten up the thread 12 and can, consequently, not be moved any further and when, on the other hand, the carrier has come into contact with one longitudinal side of the groove. On the basis of this arrangement, it is possible to drive the shaft so that additional lamellae can successively beat up the thread, when some of the lamellae have already beaten up part of the thread 12 (cf. in this respect FIG. 17).

Figure 16:
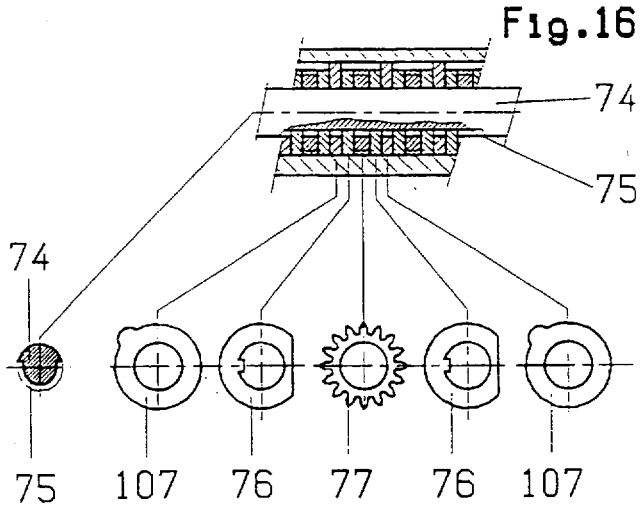
Figure 17:
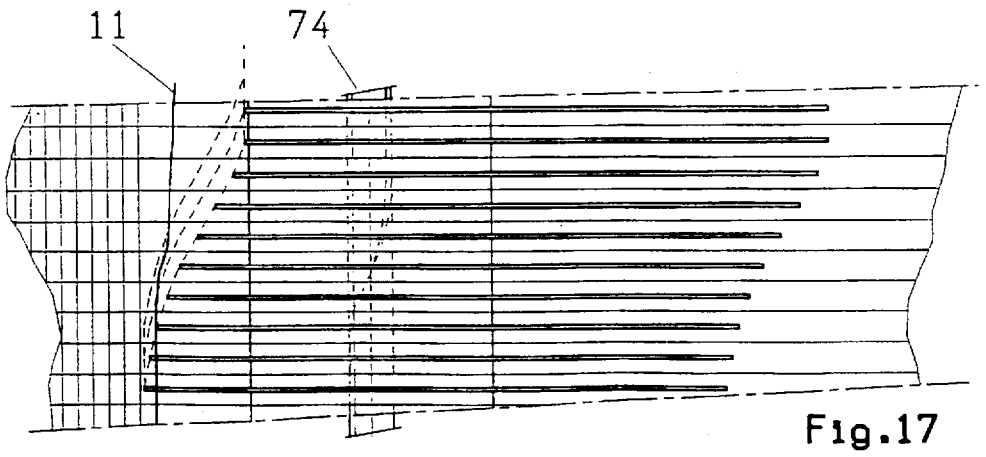

According to FIG. 16, a frictional connection of the above-mentioned type is achieved by providing on the shaft a separator element 107 between the control and transmission elements 76 and 77 of each of the various lamellae, said separator element 107 being adapted to be axially displaced relative to the shaft and secured against rotation relative to the gripper, and by axially tensioning the whole arrangement, i.e. all elements for all lamellae.

These separator elements 107, which are in frictional engagement with the control elements 76, additionally prevent the control and transmission elements, which are in frictional engagement, from rotating accidentally with the shaft, e.g. due to contamination of the device, although the carrier of the control elements is located at the centre of the groove.

Furthermore, this arrangement permits, by varying the axial tensioning, an adjustment of the force in response to which the frictional engagement will be released and, consequently, of the force with which a thread is beaten up. In addition to the arrangement described, it is also possible to cause the frictional engagement by encompassing each control elemement/transmission element combination by a clip, which is secured against rotation relative to the gripper arm.

FIG. 18A to 18I show an embodiment of the weaving-out means 80 and 80', respectively. This embodiment includes a weaving-out gripper 81 and a brush device 116.

The weaving-out gripper 81 has a gripper arm 82 as well as gripper means 110 for seizing and fixing in the gripper arm a thread 13 to be removed by weaving out.

The weaving-out gripper is secured to first and second holding devices 83 and 86. With the aid of two drive means 84 and 87, the gripper arm can be pivoted relative to these holding devices. With respect to the holding devices and the way in which the gripper arm is driven relative to these holding devices, the structural design of the weaving-out gripper is mirror-inverted relative to the structural design of the weaving-in gripper shown in FIG. 12A to 12F. It follows that the weaving-out gripper 81 can be pivotably moved from the position shown in FIG. 18A (top view) and FIG. 18B (side view) out of the weaving shed (to the position according to FIG. 18C (top view) and FIG. 18D (side view)), guided through the length of woven fabric between the auxiliary weft threads 21 and the non-opened woven material 5 (to the position according to FIG. 1BE) and moved into the area of the magazining device 90 (to the position according to FIG. 18F).

For explaining the details of the movements which can be carried out with the aid of the drive means, reference is made to the description of the weaving-in gripper in connection with FIG. 12A to 12F.

FIG. 18G to 18J show how the warp thread end 13, which has been released from the woven material, is transferred as auxiliary weft thread to the magazining device 90. This transfer operation will be explained more precisely after the description of the gripper means 110 following hereinbelow.

Figure 19:
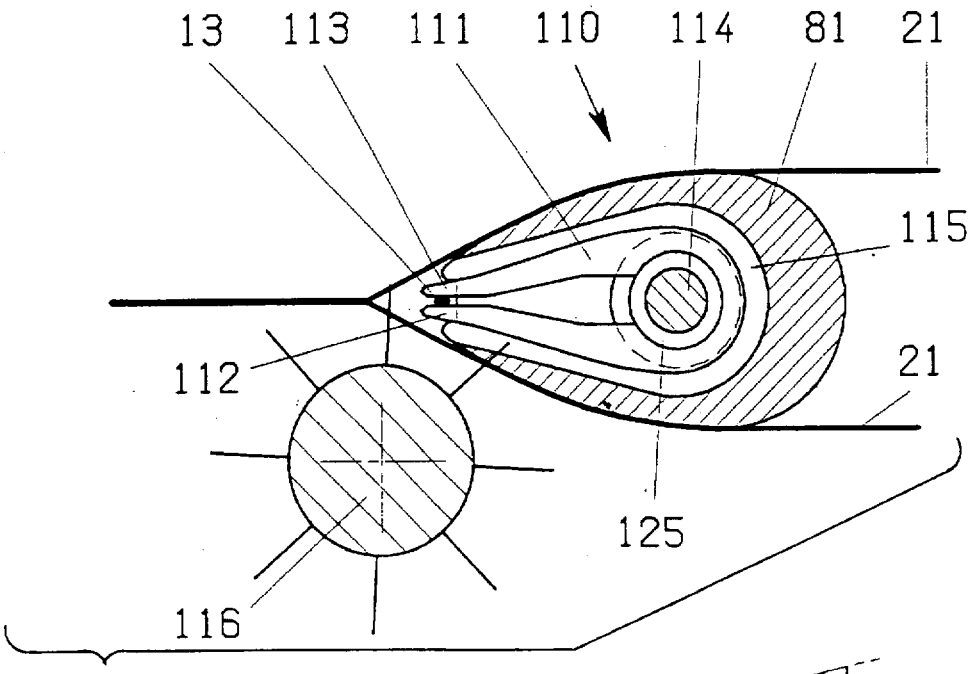
FIG. 19 shows a detail of a gripper means of the weaving-out gripper shown in FIG. 18A to 18J.

One of the gripper means 110 of the gripper arm 82 is shown in detail in FIG. 19. This gripper means is provided with a clip 111. The clip consists of flexible material, e.g. plastic material or metal. The clip 111 has provided therein an opening 125, which is engaged by a control element 114. According to FIG. 19, the opening 125 in the clip is round. This opening is engaged by a conical control element 114 (cf. in this respect also FIG. 20). By displacing the control element 114 at right angles to the opening 125 in the clip, said clip can be opened and closed, respectively, whereby a thread which has been taken hold of will be released or fixed.

The clip ends 112 and 113 can be constructed such that they are electrically insulated from each other and they can close a circuit when they come into contact with each other. In this way, it can immediately be detected whether or not a thread is located in the clip.

The gripper means 110 is accommodated in a pocket provided in the gripper arm 82.

Figure 20:
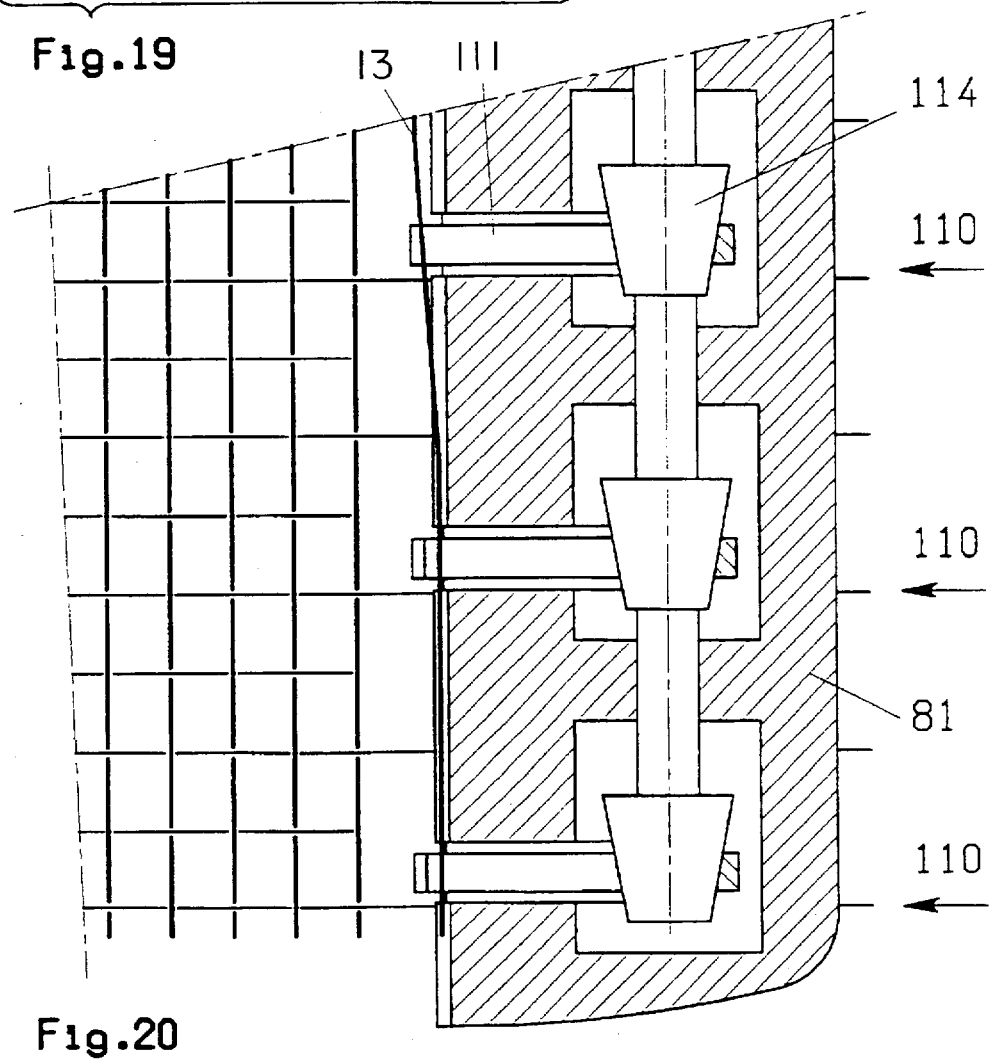
FIG. 20 shows a detail of the control of the gripper means shown in FIG. 19.

In FIG. 20, several gripper means 110 accommodated in one gripper arm 81 are shown. The conical control elements 114 are all secured to one rod. All gripper means 110 can be opened and closed in common by displacing this rod.

The gripper arm can have a modular design, one module comprising at least one gripper means 110 with its control element 114. By fitting together a plurality of such modules, an arbitrary number of gripper means can be provided in one gripper arm. By providing modules which do not contain any gripper means, but which are capable of transmitting the control for the gripper means, it is possible to arrange said gripper means at arbitrary distances from one another. The weaving-out gripper can in this way be adapted to arbitrary lengths of the warp thread ends.

In addition to the weaving-in gripper, the weaving-in means according to FIG. 19 includes a round brush 116, which is arranged in the weaving-out area of the weaving shed (or of the auxiliary weaving shed) parallel to the warp thread ends to be removed by weaving out.

At a suitable position of the shed, the respective warp thread end to be released from the woven material can be brushed towards the gripper arm by rotation of this round brush, and there it can be seized and fixed in the manner described hereinbelow. Instead of the round brush, it is also possible to use other means, e.g. compressed-air means, for driving the warp thread end in the direction of the gripper arm.

With the aid of said means 116, the warp thread end 13 is driven in the direction of the gripper arm 81 in the open condition of the gripper means 110. When the warp thread contacts the gripper arm 81 in the areas between two gripper means 110, it is guaranteed that the gripper means 110 have seized the thread 13, or, in other words, that the thread 13 is located between the clip ends 112 and 113. By actuating the control elements 114, the clips 111 can then be closed whereby the thread 11 will be fixed in the gripper arm 81.

Figure 18A:
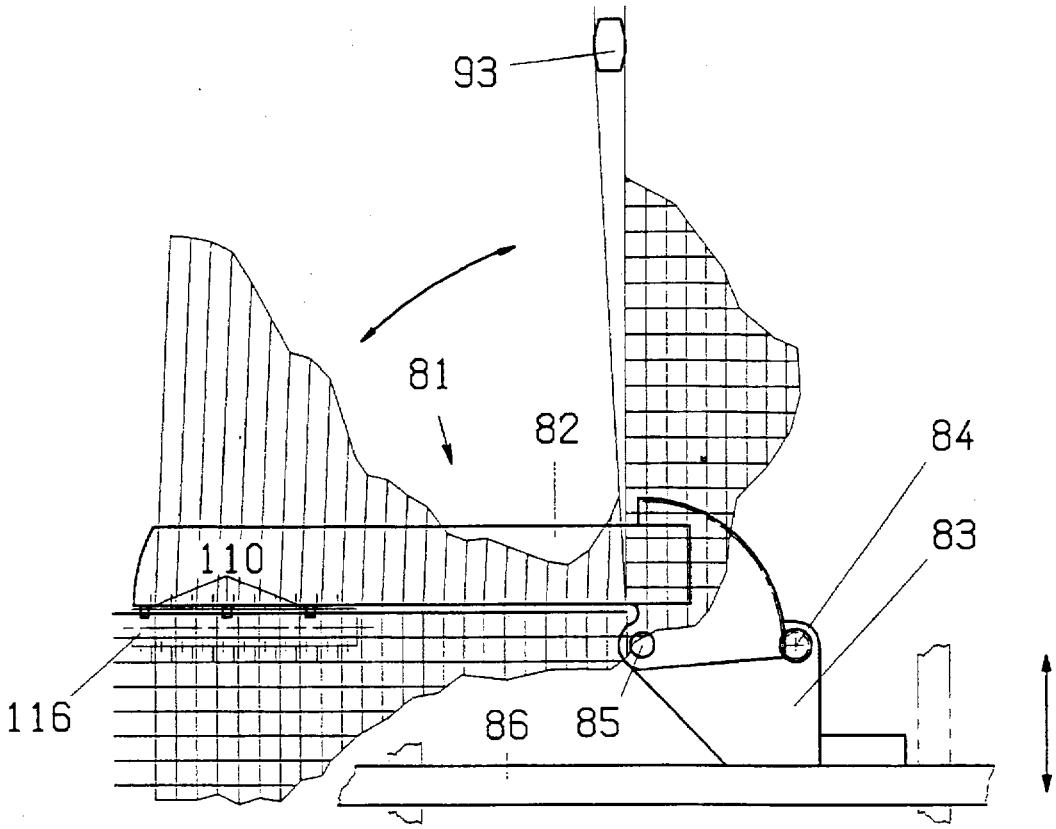
Figure 18B:
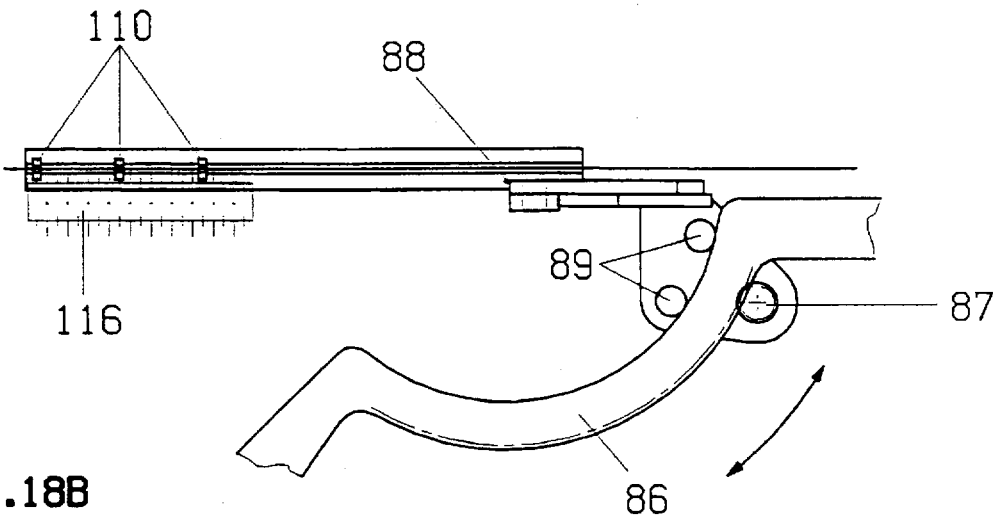
Figure 18C:
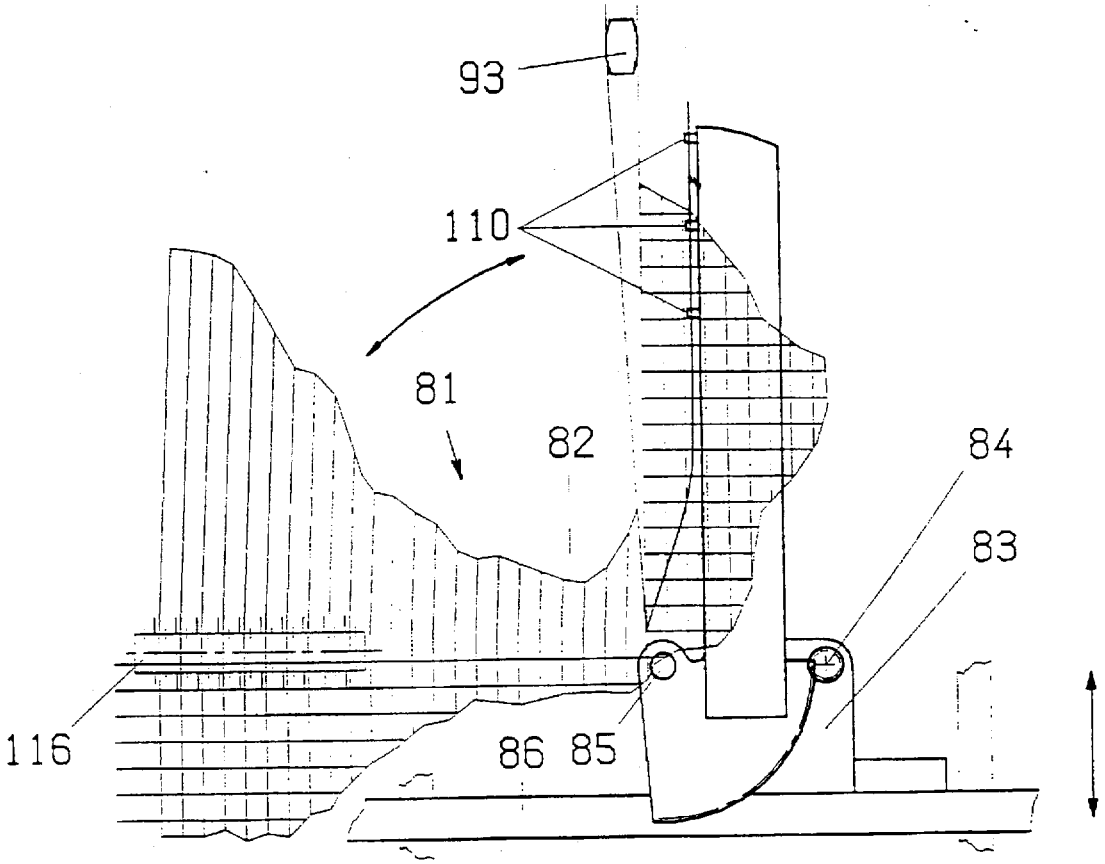
Figure 18D:
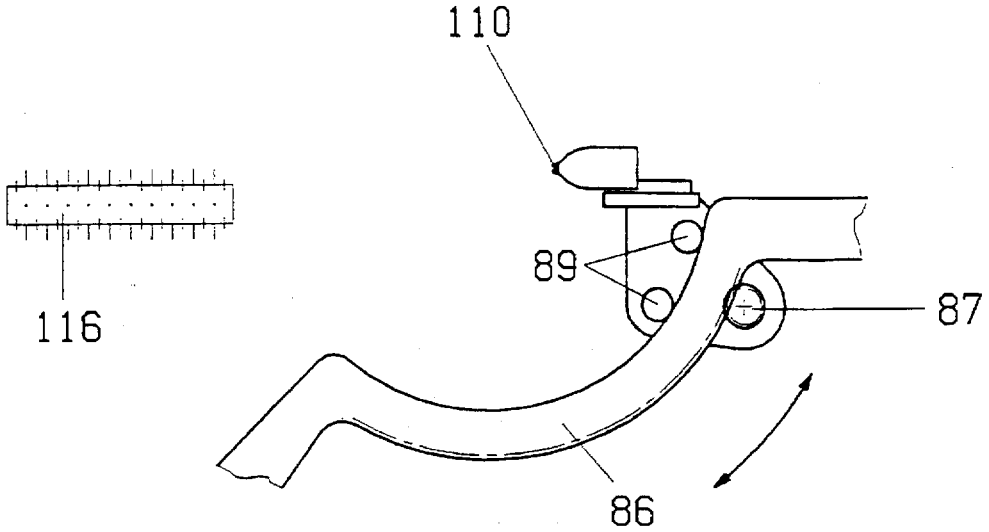
Figure 18E:
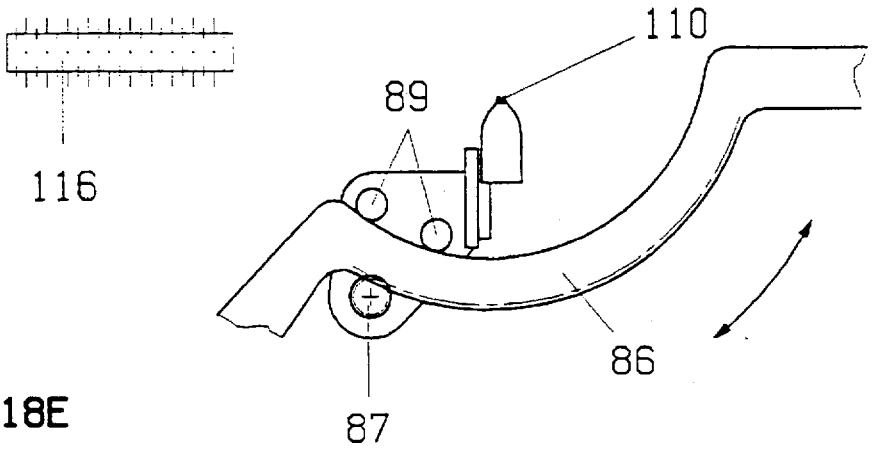
Figure 18F:
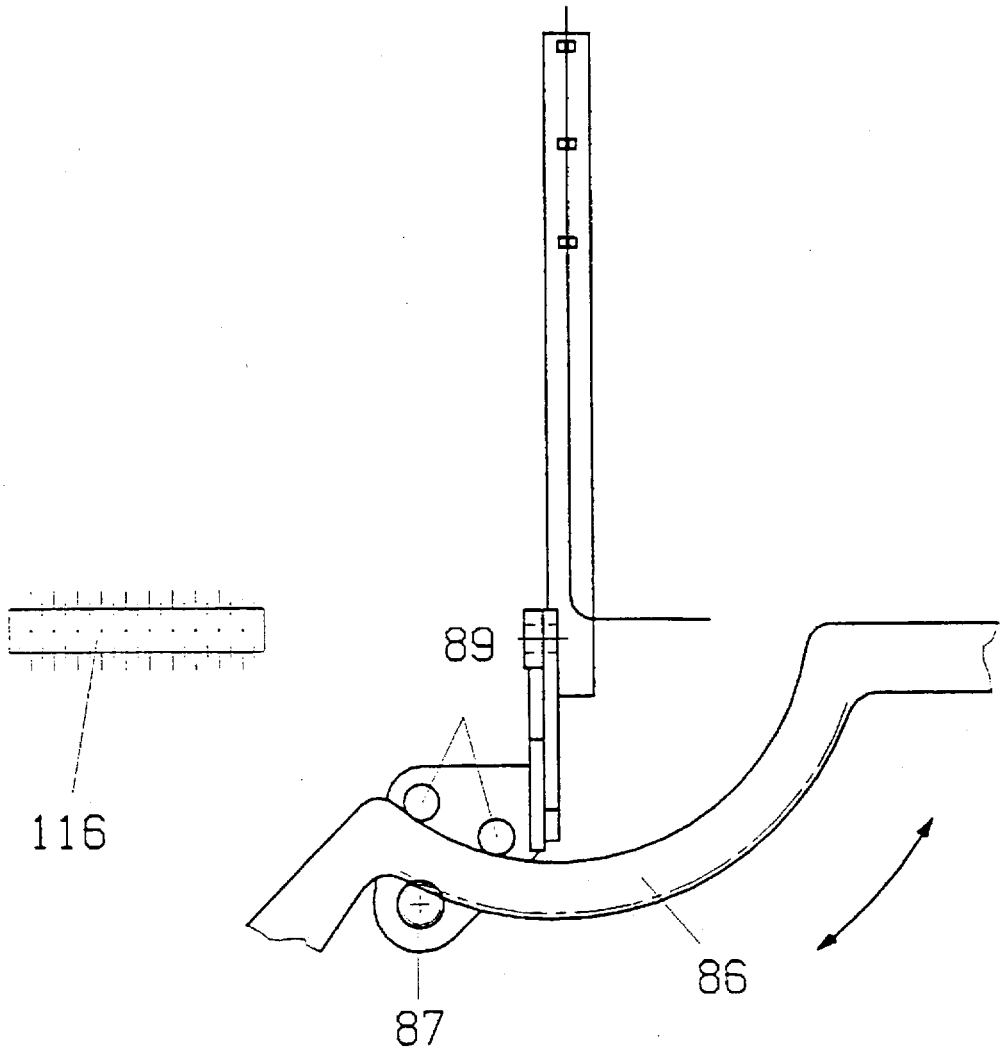
Figure 18G:
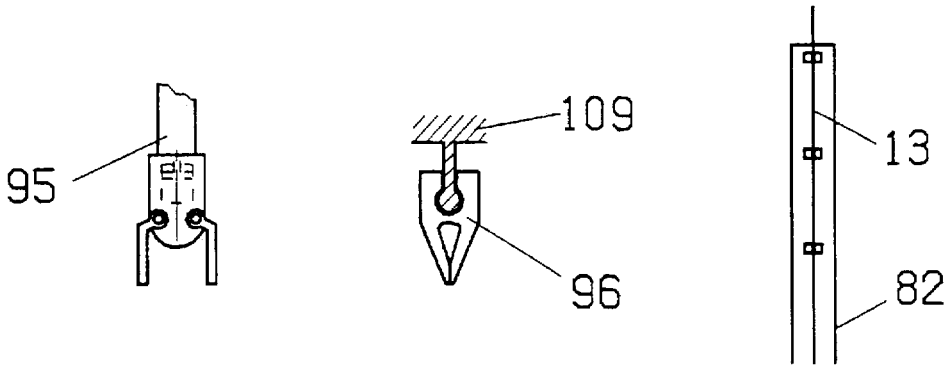

As has already been explained, the weaving-out gripper is subsequently pivoted out of the weaving-out area of the weaving shed and moved into the vicinity of the magazining device 90. This condition is shown in FIG. 18F.

Figure 18H:
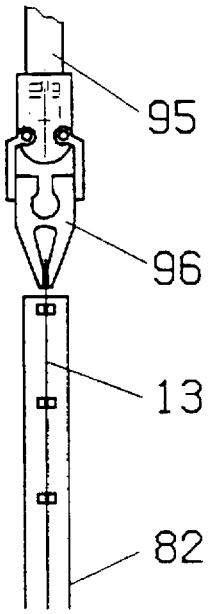
Figure 18I:
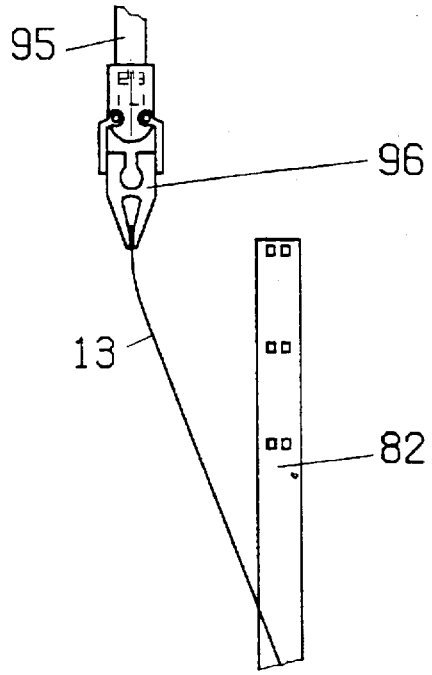
Figure 18J:
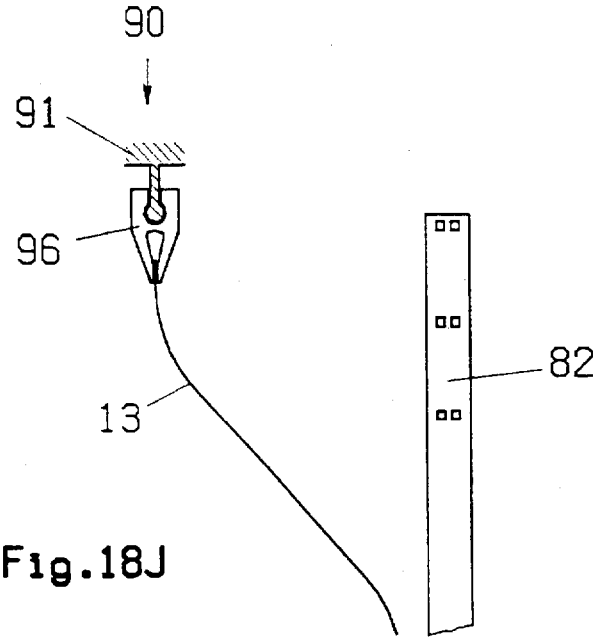

FIG. 18G to 18J show how the warp thread end which has been removed by weaving out is deposited in the magazining device 90 as auxiliary weft thread. According to FIG. 18G, a transfer means 95 is provided for this purpose, said transfer means 95 corresponding to the means shown in FIG. 11A, 11B and FIG. 11C, 11D, respectively, and described in connection with these figures. This transfer means 95 seizes with the aid of its pliers a clip 96, which is made available from a storage rail 109. It is now possible to remove the clip 96 from the storage rail with the aid of said transfer means 95. By closing the pliers still further, the clip is opened in the area of its clip ends whereupon it can take hold of the thread fixed by the weaving-out gripper. By slightly opening the pliers of the transfer means 95, the warp thread end is fixed in the clip 96. This condition is shown in FIG. 18H. Following this, the gripper means 110 are opened by actuating the control elements 114 whereupon the gripper arm will release the warp thread end. The transfer means 95 can now guide the clip 96, which has the warp thread end 13 secured thereto, to the magazining device (FIG. 18I) and thread said clip onto the rail 91 of said magazining device 90 (FIG. 18J).

I claim:

1. An apparatus for mechanically producing a seam (2) for making a length of woven fabric (3) endless, said length of woven fabric having a first end portion and a second end portion and being formed of warp threads (10) extending longitudinally to the direction of said length of woven fabric as well as of weft threads (20) extending transversely to said direction, comprising a shedding mechanism (58) for forming a weaving shed using auxiliary warp threads (21), two weaving-in means (60; 60') for weaving auxiliary weft threads into the auxiliary warp threads in a weaving-in area of the weaving shed in accordance with a weaving order predetermined for producing the seam, characterized by a first means (80) for weaving out warp thread ends (11), which are to be released from the woven material and which are taken from one of the end portions of the length of woven fabric, in a weaving-out area located opposite the weaving-in area of the shed, in such a way that a group of weft threads in this end portion is partially exposed and that these weft threads in the exposed area are used as auxiliary warp threads (21) for forming the weaving shed, and a first magizining device (90) for defined deposition of the warp thread ends, which have been removed from the woven material with the aid of the first weaving-out means (80), as auxiliary weft threads (11) and for transferring to the first weaving-in means (60) the respective first auxiliary weft thread deposited, an auxiliary shedding mechanism (59) for forming an auxiliary weaving shed having an auxiliary weaving-out area, a second means (80') for weaving out warp thread ends (11'), which are to be released from the woven material and which are taken from the other end portion of the length of woven fabric, in the weaving-out area of the auxiliary weaving shed, in such a way that a group of weft threads in this end portion of the length of woven fabric is partially exposed and that these weft threads in the exposed area are used as auxiliary warp threads (21') for forming the auxiliary weaving shed, and a second magazining device (90') for defined deposition of the warp thread ends, which have been removed from the woven material with the aid of the second weaving-out means (80'), as auxiliary weft threads (11') and for transferring to the second weaving-in means (60') the respective first auxiliary weft thread deposited.

2. An apparatus according to claim 1, characterized in that the shedding mechanism (58) and the auxiliary shedding mechanism (59) are coupled such that the weaving-out operations of the respective first warp thread ends forming still part of the woven material of the first and second end portions (4; 4') of the length of woven fabric take place simultaneously.

3. A method for producing a seam for making a length of woven fabric endless, said length of woven fabric having at least one end portion formed of a plurality of warp threads extending longitudinally relative to a first direction of said length of woven fabric and a plurality of weft threads extending transversely to said direction, said method comprising the steps of (a) mechanically releasing a portion of a predetermined number of warp threads from the woven fabric end portion, thereby exposing a group of weft threads bordering on the non-released length of woven fabric, whereby the released warp threads serve as auxiliary weft threads and the exposed weft threads serve as auxiliary warp threads; and (b) successively mechanically weaving the auxiliary weft threads into the auxiliary warp threads according to a predetermined weaving order, thereby producing the seam.

4. A method for producing a helical half seam for making a length of woven fabric endless, said length of woven fabric having a first side and a second side and being formed of a plurality of warp threads extending parallel to a first direction of the length of woven fabric and a plurality of weft threads extending transversely to said direction, said method comprising the steps of (a) mechanically successively releasing the ends of a predetermined number of warp threads from the length of woven fabric first side, thereby exposing a portion of the weft threads, said released warp thread portions serving as auxiliary weft threads, said exposed weft thread portions forming a weaving shed having a weaving-out area located adjacent to the portion of woven fabric from which the warp threads were released and a weaving-in area located remote from the weaving-out area;

(b) subdividing the exposed portions of the weft threads forming the weaving shed into a first auxiliary warp thread group located adjacent to the woven fabric between the weaving-in and weaving-out areas and a second auxiliary warp thread group separated from the first auxiliary warp thread group by a wire helix; and (c) successively mechanically weaving-in the auxiliary weft threads in the weaving-in area according to a predetermined weaving order, thereby to connect the wire helix to the woven fabric and form the seam.

5. A method according to claim 4, characterized in that, during the weaving-in operation, the respective auxiliary weft thread (50) is woven into the first auxiliary warp thread group only up to a predetermined auxiliary warp thread (160) where it is guided out of the weaving plane.

6. A method according to claim 4, wherein during the weaving-in operation, the respective auxiliary weft thread (51; 52) is woven in up to the last auxiliary warp thread (161) of the first auxiliary warp thread group, whereupon it is guided around one of said last auxiliary warp thread and the wire helix and woven back up to a predetermined auxiliary warp thread (160) where it is guided out of the weaving plane.

7. A method according to claim 6, characterized in that at least some of the auxiliary weft threads (57) woven in up to the last auxiliary warp thread are turned about their longitudinal axes prior to being woven back.

8. A method according to claim 4, wherein during the weaving-in operation, the respective auxiliary weft thread (53; 55; 56) is woven in up to the last auxiliary warp thread (161) of the first auxiliary warp thread group, temporarily deposited in a deposition device (38), guided around one of the last auxiliary warp thread and the wire helix, and woven back up to a predetermined auxiliary weft thread (160) where it is guided out of the weaving plane, and further wherein the weaving-in operation of a temporarily deposited auxiliary weft thread is not finished until the weaving-in operation for at least one additional auxiliary weft thread has been started or finished.

9. A method according to claim 4, characterized in that, for inserting the weaving shed on the first side (6) of the length of woven fabric, the outermost warp thread end is released first and that, subsequently, a predetermined number of warp thread ends is released in accordance with the weaving order, and that the exposed weft threads are fixed as auxiliary warp threads in such a way that the formation of the weaving shed is made possible.

10. A method according to claim 4, characterized in that, for inserting the weaving shed, a warp thread end located adjacent the first side is released, and that, subsequently, a pedetermined number of additional warp thread ends is released in the direction of the second side of the length of woven fabric in accordance with the weaving pattern of said length of woven fabric so that a lateral strip in the woven material will remain in which the exposed weft threads remain fixed as auxiliary warp threads and permit the formation of the weaving shed in this way.

11. A method for producing a pin seam for making a length of woven fabric endless, said length of woven fabric being formed of a plurality of warp threads extending parallel to a first direction of the length of woven fabric and a plurality of weft threads extending transversely to said direction, said length of woven fabric including first and second end portions, said method comprising the steps of:

(a) weaving-out a predetermined amount of successive warp thread ends from the woven fabric first end portion, thereby exposing a portion of successive weft threads of the fabric first end portion which serve as auxiliary warp threads;

(b) forming a first weaving shed in the fabric first end portion from the exposed weft thread portions of the first fabric end portion, said first weaving shed having a weaving-out area located adjacent to an area where the warp thread ends were removed from the woven fabric and a weaving-in area remote from the weaving-out area;

(c) depositing the first end portion woven-out warp threads in a deposition device, thereby forming a first auxiliary weft thread group;

(d) weaving-out a predetermined amount of successive warp thread ends from the woven fabric second end portion, thereby exposing a portion of the weft threads of the fabric second end portion which serve as auxiliary warp threads;

(e) forming a second auxiliary weaving shed in the fabric second end portion from the exposed portions of the weft threads of the second end portion;

(f) depositing the fabric second end portion woven-out warp threads in a deposition device, thereby forming an auxiliary weft thread group;

(g) subdividing the fabric first end portion auxiliary warp threads into a first auxiliary warp thread group arranged adjacent to the woven fabric and a second auxiliary warp separated from the first auxiliary thread group by a wire;

(h) weaving-in the auxiliary weft threads of the first auxiliary weft thread group in the weaving-in area according to a predetermined weaving order, thereby to releasably connect the wire with the woven fabric first end portion; and (i) weaving-in the auxiliary weft threads of the second auxiliary weft thread group according to a predetermined weaving order, thereby to releasably connect the wire with the second end portion of the length of woven fabric.

12. A method as defined in claim 11, wherein for each auxiliary weft thread of the second auxiliary weft thread group which is woven-in, a corresponding auxiliary weft thread of the first auxiliary weft thread group is woven in.

13. A method according to claim 11, wherein during the weaving-in operation of one of the auxiliary weft threads of one of the first and the second auxiliary weft thread groups, the respective auxiliary weft thread is woven into the corresponding auxiliary warp thread group only up to a predetermined auxiliary warp thread where it is guided out of the weaving plane.

14. A method according to claim 11, wherein during the weaving-in operation of one of the auxiliary weft threads of one of the first and the second auxiliary weft thread groups, the respective auxiliary weft thread is woven in up to the last auxiliary warp thread of the corresponding auxiliary warp thread group, whereupon it is guided around one of said last auxiliary warp thread and the central wire and woven back up to a predetermined auxiliary warp thread where it is guided out of the weaving plane.

15. A method according to claim 11, wherein during the weaving-in operation of one of the auxiliary weft threads of one of the first and second auxiliary weft thread groups, the respective auxiliary weft thread is woven in up to the last auxiliary warp thread of one of the first and second auxiliary warp thread groups, temporarily deposited in a corresponding deposition device (38; 38'), guided around one of the last auxiliary warp thread and the central wire, and woven back up to a predetermined auxiliary weft thread where it is guided out of the weaving plane, the weaving-in operation of the temporarily deposited auxiliary weft threads being not finished until the weaving-in operation for at least one of the additional auxiliary weft threads has been started or finished.

16. A method according to claim 15, wherein at least one of the auxiliary weft threads woven in up to the last auxiliary warp thread is turned about its longitudinal axes prior to being woven back.

17. A method for producing an endless seam for making a length of woven fabric endless, said length of woven fabric having a first side and a second side and being formed of a plurality of warp threads extending parallel to a first direction of the length of woven fabric and a plurality of weft threads extending transversely to said direction, said length of woven fabric including first and second end portions, said method comprising the steps of:

(a) weaving-out a predetermined amount of successive warp thread ends from the woven fabric first end portion, thereby exposing a portion of successive weft threads of the fabric first end portion which serve as auxiliary warp threads;

(b) forming a first weaving shed in the fabric first end portion from the exposed portions of the weft threads of the first fabric end portion, said first weaving shed having a weaving-out area located adjacent to an area where the warp thread ends were removed from the woven fabric and a weaving-in area remote from the weaving-out area;

(c) depositing the first end portion woven-out warp threads in a deposition device, thereby forming a first auxiliary weft thread group;

(d) weaving-out a predetermined amount of successive warp thread ends from the woven fabric second portion, thereby exposing a portion of the weft threads of the fabric second end portion which serve as auxiliary warp threads;

(e) forming a second weaving shed in the fabric second end portion from the exposed portions of the weft threads of the second end portion;

(f) depositing the fabric second end portion woven-out warp threads in a deposition device, thereby forming a second auxiliary weft thread group;

(g) weaving the first deposited auxiliary weft thread of the first auxiliary weft thread group into the auxiliary warp threads in accordance with a predetermined weaving order up to a predetermined auxiliary warp thread and then guiding the auxiliary weft thread out of the weaving plane;

(h) weaving the first deposited auxiliary weft thread of the second auxiliary weft thread group into the auxiliary warp threads in accordance with the predetermined weaving order up to a predetermined auxiliary warp thread and then guiding the auxiliary weft thread out of the weaving plane; and (i) repeating steps (g) and (h) until all of the auxiliary weft threads of the first and second auxiliary weft thread groups have been alternately woven-in, thereby to connect the first end of the length of woven fabric to the second end.

18. A method according to claim 17, characterized in that, for inserting the weaving sheds, the outermost warp thread end is first released on the first and on the second end as well as on the first side of the length of woven fabric, and that, subsequently, a predetermined number of warp thread ends is released in accordance with the weaving order of the length of woven fabric, and that the exposed weft threads of the first and of the second end of the length of woven fabric are fixed as auxiliary warp threads in such a way that the formation of the weaving shed and of the auxiliary weaving shed, respectively, is made possible.

19. A method according to claim 17, characterized in that, for inserting the weaving sheds, a warp thread end located in the vicinity of the first side is released on the first and on the second end as well as on the first side of the length of woven fabric, and that, subsequently, a predetermined number of further warp thread ends is released in the direction of the second side of the length of woven fabric in accordance with the weaving order of the length of woven fabric so that a lateral strip in the woven material of said first and second ends, respectively, will remain in which the exposed weft threads of said first and second ends, respectively, remain fixed as auxiliary warp threads and permit the formation of the weaving shed and of the auxiliary weaving shed, respectively, in this way.

20. A method according to claim 17, characterized in that the shed positions of the weaving shed and of the auxiliary weaving shed are coupled such that the weaving-out operations of the respective following warp thread ends (13, 13'), which still form part of the woven material of the first and second ends, are carried out simultaneously.

21. Apparatus for producing a seam half for making a length of woven fabric endless, said length of woven fabric being formed of a plurality of warp threads extending longitudinally relative to a direction of said length of woven fabric and a plurality of weft threads extending transversely to said direction, comprising (a) weaving-out means for successively releasing the ends of a predetermined number of warp threads from the length of woven fabric, thereby partially exposing a portion of the weft threads, said exposed weft thread portions forming a weaving shed having a weaving-out area located adjacent to the portion of woven fabric from which the warp threads were released and a weaving-in area located remote from the weaving-out area;

(b) magazine means for receiving the warp thread ends removed from the woven fabric, said removed warp thread ends serving as auxiliary weft threads;

(c) shedding means for forming and controlling the position of said weaving shed; and (d) weaving-in means for weaving-in said auxiliary weft threads released from the woven fabric into the auxiliary warp threads of the weaving shed in the weaving-in area in accordance with a predetermined weaving order, thereby producing the seam.

22. An apparatus according to claim 21, characterized in that each weaving-in means (60; 60') comprises a weaving-in gripper (61) which is adapted to be pivoted into the weaving-in area of the weaving shed, and a deposition device (79) for temporarily receiving therein one or a plurality of auxiliary weft threads (11; 11') woven in by the weaving-in gripper, said deposition device being provided in the area in which the end of the weaving-in gripper is located when it has been pivoted in.

23. An apparatus according to claim 22, characterized in that the deposition device (79) is constructed such that it is adapted to rotate about its longitudinal axis.

24. An apparatus according to claim 23, characterized in that each weaving-in means is provided with a weaving-in gripper (61; 61') which is adapted to be pivoted into the weaving-in area of the weaving shed.

25. An apparatus according to one of the claim 21, characterized in that each weaving-out means (80; 80') is provided with a weaving-out gripper (81; 81') which is adapted to be pivoted into the weaving-out area of the weaving shed and of the auxiliary weaving shed, respectively.

26. An apparatus according to claim 21, characterized in that each magazining device (90; 90') comprises a first transfer means (95) providing the end of the respective warp thread with a clip (96) and transferring said clip to a rail (91; 91') onto which the clip can be threaded and along which said clip can slidably be moved, and a second transfer means (98) for transferring to the weaving-in means (60, 60') the respective first clip which has been deposited.

* * * * *

UNITED STATES PATENT AND TRADEMARK OFFICE

CERTIFICATE OF CORRECTION

PATENT NO. : 5,720,323

DATED : February 24, 1998

INVENTOR(S) : Siegmund TREMER

It is certified that error appears in the above-identified patent and that said Letters Patent is hereby corrected as shown below:

On the title page, insert the following after item [76]:
--[73] Assignee: Staubli GmbH of Bayreuth, Germany--.

Signed and Sealed this

Sixteenth Day of January, 2001

*Attest:*

*Attesting Officer*

Q. TODD DICKINSON

*Commissioner of Patents and Trademarks*